US008740723B2

(12) United States Patent
Kuan et al.

(10) Patent No.: US 8,740,723 B2
(45) **Date of Patent: *Jun. 3, 2014**

(54) GOLF CLUB HEAD

(71) Applicant: SRI Sports Limited, Kobe (JP)

(72) Inventors: Jimmy H. Kuan, West Covina, CA (US); Samuel G. Lacey, Huntington Beach, CA (US); Dan S. Nivanh, Long Beach, CA (US); Nathaniel J. Radcliffe, Huntington Beach, CA (US)

(73) Assignee: SRI Sports Limited, Kobe-Shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/682,343

(22) Filed: Nov. 20, 2012

(65) Prior Publication Data

US 2013/0079177 A1 Mar. 28, 2013

Related U.S. Application Data

(63) Continuation of application No. 12/910,241, filed on Oct. 22, 2010, now Pat. No. 8,337,323.

(51) Int. Cl.
*A63B 53/04* (2006.01)

(52) U.S. Cl.
USPC ..... 473/345; 473/327

(58) Field of Classification Search
CPC ..... A63B 53/04; A63B 53/0466; A63B 2053/04; A63B 2053/0404; A63B 2053/0408; A63B 2053/0412; A63B 2053/0433; A63B 2053/0437; A63B 2053/045
USPC ..... 473/345–346, 324, 327, 343, 344, 349
See application file for complete search history.

(56) References Cited

U.S. PATENT DOCUMENTS

| | | | | |
|---|---|---|---|---|
| 4,828,265 | A * | 5/1989 | Antonious | 473/327 |
| 5,004,241 | A * | 4/1991 | Antonious | 473/327 |
| 5,092,599 | A * | 3/1992 | Okumoto et al. | 473/327 |
| 5,221,086 | A * | 6/1993 | Antonious | 473/327 |
| 5,923,561 | A | 7/1999 | Higasayama et al. | |
| 5,941,782 | A * | 8/1999 | Cook | 473/346 |
| 6,319,148 | B1 * | 11/2001 | Tom | 473/290 |

(Continued)

OTHER PUBLICATIONS

Wilson, M. et al., "Top Gun," *The Golf Club Identification & Price Guide IV*, 1999, p. 49-15, Golf-Works/Ralph Maltby Enterprises.

(Continued)

*Primary Examiner* — Stephen L. Blau
(74) *Attorney, Agent, or Firm* — Oliff PLC

(57) ABSTRACT

A golf club head includes a striking face having a face center, a bottom portion, a top portion including an exterior surface, a hosel including an imaginary vertical hosel plane, a forwardmost point, and a rearwardmost point. In an imaginary vertical plane perpendicular to the hosel plane and passing through the face center, the exterior surface includes a path having a first point and a second point rearward of the first point. An imaginary infinite straight line passes through the first point and the second point, but does not penetrate the exterior surface. A segment of the imaginary straight line is delimited by the first point and the second point. A maximum distance between the segment and the exterior surface of the top portion is no greater than 0.70 mm and a distance between the first point and the second point is no less than 22 mm.

38 Claims, 26 Drawing Sheets

(56) References Cited

U.S. PATENT DOCUMENTS

| | | | | |
|---|---|---|---|---|
| 6,605,006 | B2 * | 8/2003 | Mason | 473/252 |
| 7,156,750 | B2 * | 1/2007 | Nishitani et al. | 473/329 |
| 7,431,667 | B2 * | 10/2008 | Vincent et al. | 473/345 |
| 7,470,200 | B2 * | 12/2008 | Sanchez | 473/328 |
| 7,887,433 | B2 * | 2/2011 | Hoffman et al. | 473/327 |
| 8,409,030 | B2 * | 4/2013 | Hoffman et al. | 473/332 |
| 8,556,742 | B2 * | 10/2013 | John | 473/219 |
| 2006/0090336 | A1 | 5/2006 | Graham et al. | |
| 2007/0298903 | A1 * | 12/2007 | Stites et al. | 473/324 |
| 2010/0111628 | A1 | 5/2010 | Megens et al. | |
| 2010/0292018 | A1 * | 11/2010 | Cackett et al. | 473/246 |
| 2011/0118051 | A1 * | 5/2011 | Thomas | 473/328 |
| 2012/0083363 | A1 * | 4/2012 | Albertsen et al. | 473/346 |

OTHER PUBLICATIONS

"Dynacraft Golf 1994 Product Catalog," p. 47, Dynacraft RSB 7185 section.

"Nicklaus Golf Equipment 1998 Product Catalogue," Air Bear 2 Woods section.

Ping G5 golf club, Apr. 17, 2008; info and specs found at: http://www.golfreview.com/cat/fairway-woods/ping/PRD_342003_2939crx.aspx.

Ping G10 golf club, Oct. 23, 2007; http://valueguide.pga.com/detail-exec/brand/2736/product_type/203/model/47115/b/Ping/p/Driver/m/G10.

Nike SQ460 golf club, Jun. 3, 2008; info and specs found at: http://www.golfreview.com/cat/drivers/nike/PRD_343578_2948crx.aspx.

SQ Sumo golf club, Feb. 1, 2008; http://valueguide.pga.com/detail-exec/brand/2724/product_type/203/model/47188/b/Nike/p/Driver/m/SQ_Sumo_5000.

Cleveland Golf HiBore Monster XLS golf club, Jan. 10, 2009; info and specs found at: http://golf.about.com/od/equipmentreviews/ss/elevelandwin09.htm.

CG HiBore Bloom golf club, Feb. 15, 2009; http://valueguide.pga.com/detail-exec/brand/2677/product_type/203/model/47587/b/Cleveland/p/Driver/m/Hi-Bore_Bloom.

Callaway FT-TZ golf club, Nov. 24, 2009; http://valueguide.pga.com/detail-exec/brand/2675/product_type/203/model/47677/b/Callaway/p/Driver/m/FT-iZ.

Golfsmith SR-460 golf club, Feb. 12, 2007; info and specs found at; http://www.golfgearreview.com/article-display/2215.html.

Nike VR golf club, Mar. 26,2010; info and specs found at: http://www.nike.com/nikeos/p/nikegolf/en_US/experiences/victory-red-drivers.

Taylor Made, Burner Superfast golf club, May 4, 2010; info and specs found at: http://www.taylormadegolf.com/mainlevel/golfshop/drivers/BURNER-SUPERFAST.html?IsPopUp-0-30.

* cited by examiner

GOLF CLUB HEAD

This is a Continuation of application Ser. No. 12/910,241 filed Oct. 22, 2010. The disclosure of the prior application is hereby incorporated by reference herein in its entirety.

COPYRIGHT AUTHORIZATION

The disclosure below may be subject to copyright protection. The copyright owner has no objection to the facsimile reproduction by any one of the documents containing this disclosure, as they appear in the Patent and Trademark Office records, but otherwise reserves all applicable copyrights.

BACKGROUND OF THE INVENTION

It is generally known to those skilled in the art of golf club making that an increased moment of inertia (MOI) of a golf club head is associated with improved performance on off-center shots. Greater club-head MOI may be achieved by increasing the projected area of the head onto the ground plane (i.e., "footprint"), most commonly associated with an increase in head volume. However, rules promulgated by the United States Golf Association (USGA) contain provisions regulating volume and other parameters of the golf club head. In view of these considerations, manufacturers have attempted to maximize the projected area of the golf club head without exceeding existing USGA limitations by offering club heads having non-traditional shapes. However, acceptance of such shapes by golfers has been limited. Additionally, some non-traditional designs have been associated with undesirable acoustic characteristics.

SUMMARY

The present invention, in one or more aspects thereof, may advantageously comprise a golf club head that, while conforming to USGA regulations, delivers an increased projected area and a greater moment of inertia, maintains a traditional shape, and provides a favorable dynamic-excitation response.

In an embodiment according to one or more aspects of the present invention, the golf club head, when oriented in a reference position, includes a bottom portion, a top portion opposite the bottom portion, and a striking face having a face center. The top portion has an exterior surface. The golf club head also includes a forwardmost point, a rearwardmost point opposite the forwardmost point, a hosel having an imaginary centerline, and an imaginary vertical hosel plane containing the imaginary centerline. In an imaginary vertical plane perpendicular to the imaginary vertical hosel plane, the exterior surface of the top portion includes a path comprising a first point and a second point rearward of the first point. An imaginary infinite straight line passes through the first point and the second point, but does not penetrate the exterior surface of the top portion. A segment of the imaginary straight line is delimited by the first point and the second point. A two-dimensional space is bounded by the first point, the second point, the path, and the imaginary infinite straight line. A maximum distance, measured perpendicular to the imaginary straight line, between the segment and the exterior surface of the top portion, is no greater than 0.70 mm, and a distance between the first point and the second point is no less than 22 mm. Preferably, the imaginary vertical plane perpendicular to the imaginary hosel plane passes through the face center.

In an embodiment according to one or more aspects of the present invention, the golf club head, when oriented in a reference position, includes a striking face having a face center and a center apex, a bottom portion, and a top portion opposite the bottom portion. The top portion has an exterior surface. The golf club head also includes a forwardmost point, a rearwardmost point opposite the forwardmost point, a hosel having an imaginary centerline, and an imaginary vertical hosel plane containing the imaginary centerline. An overall length $L_o$ of the golf club head corresponds to a shortest distance between a first imaginary vertical plane, parallel to the imaginary vertical hosel plane and passing through the forwardmost point of the club head, and a second imaginary vertical plane, parallel to the hosel plane and passing through the rearwardmost point. In a third imaginary vertical plane, perpendicular to the imaginary vertical hosel plane and passing through the face center, the exterior surface of the top portion includes a path having a first point and a second point rearward of the first point. An imaginary infinite straight line passes through the first point and the second point, but does not penetrate the exterior surface of the top portion. A segment of the imaginary straight line is delimited by the first point and the second point. $D_1$ is a distance between the first point and the second point. A two-dimensional space is bounded by the first point, the second point, the path, and the imaginary infinite straight line. A distance $D_2$ between the center apex and the first point of the segment of the imaginary straight line is such that $D_2/L_o$ is no less than 0.10. $D_{max}$ is a maximum distance, measured perpendicular to the imaginary straight line, between the segment and the exterior surface of the top portion. $D_{max}/D_1$ is no greater than 0.023.

In an embodiment according to one or more aspects of the present invention, the golf club head, when oriented in a reference position, includes a striking face having a face center and a center apex, a bottom portion, and a top portion opposite the bottom portion. The top portion has an exterior surface. The golf club head also includes a forwardmost point, a rearwardmost point opposite the forwardmost point, a hosel having an imaginary centerline, and an imaginary vertical hosel plane containing the imaginary centerline. In an imaginary vertical plane, perpendicular to the imaginary vertical hosel plane and passing through the face center, the exterior surface of the top portion includes a path having a first point and a second point rearward of the first point. An imaginary infinite straight line passes through the first point and the second point, but does not penetrate the exterior surface of the top portion. A segment of the imaginary straight line is delimited by the first point and the second point. A two-dimensional space is bounded by the first point, the second point, the path, and the imaginary infinite straight line. $D_1$ is a distance between the first point and the second point. $D_2$ is a distance between the center apex and the first point. $D_{max}$ is a maximum distance, measured perpendicular to the imaginary straight line, between the segment and the exterior surface of the top portion. $D_{max}/D_1$ is no greater than 0.023 and $D_1/D_2$ is no greater than 3.0.

In an embodiment according to one or more aspects of the present invention, the golf club head, when oriented in a reference position, includes a bottom portion, a top portion opposite the bottom portion, and a striking face having a face center. The top portion has an exterior surface and a maximum height $H_{max}$. The golf club head also includes a forwardmost point, a rearwardmost point opposite the forwardmost point, a hosel having an imaginary centerline, and an imaginary vertical hosel plane containing the imaginary centerline. The rearwardmost point of the head has a height $H_{rear}$ such that $H_{rear}/H_{max}$ is no greater than 0.30. In an imaginary vertical plane perpendicular to the imaginary vertical hosel plane and passing through the face center, the exterior surface of the top portion includes a path having a first point and a second point rearward of the first point. An imaginary infinite straight line passes through the first point and the second point, but does not penetrate the exterior surface of the top portion. A segment of the imaginary straight line is delimited by the first point and the second point. $D_1$ is a distance between the first point and the second point. A two-dimensional space is bounded by the first point, the second point, the path, and the imaginary infinite straight line. $D_{max}$ is a maximum distance, measured perpendicular to the imaginary straight line, between the segment and the exterior surface of the top portion. $D_{max}/D_1$ is no greater than 0.035.

In an embodiment according to one or more aspects of the present invention, the golf club head, when oriented in a reference position, includes a bottom portion, a top portion opposite the bottom portion, and a striking face having a face center. The top portion has an exterior surface. The golf club head also includes a forwardmost point, a rearwardmost point opposite the forwardmost point, a hosel having an imaginary centerline, an imaginary vertical hosel plane containing the imaginary centerline, and a fully recessed region consisting of all points on the exterior surface of the top portion located such that every imaginary infinite straight line that passes through any one of such points also penetrates the exterior surface of the top portion. The fully recessed region has an associated volume no greater than 0.1 cc, the associated volume consisting of all spatial points above the top portion of the club head located such that every imaginary infinite straight line that passes through any one of such spatial points also penetrates the exterior surface of the top portion. In an imaginary vertical plane perpendicular to the imaginary vertical hosel plane and passing through the face center, the exterior surface of the top portion includes a path comprising a first point and a second point rearward of the first point. An imaginary infinite straight line passes through the first point and the second point, but does not penetrate the exterior surface of the top portion. A segment of the imaginary straight line is delimited by the first point and the second point. A two-dimensional space is bounded by the first point, the second point, the path, and the imaginary infinite straight line. A maximum distance, measured perpendicular to the imaginary straight line, between the segment and the exterior surface of the top portion is no greater than 0.90 mm. A distance between the first point and the second point is no less than 22 mm.

In an embodiment according to one or more aspects of the present invention, the golf club head is a wood-type golf club head which, when oriented in a reference position, displays the following characterics. The golf club head includes a striking face having a face center and a center apex, a bottom portion, and a top portion opposite the bottom portion. The top portion includes an exterior surface. The golf club head also includes a forwardmost point, a rearwardmost point opposite the forwardmost point, a hosel having an imaginary centerline, and an imaginary vertical hosel plane containing the imaginary centerline. A volume of the club head is no less than 150 cc. In an imaginary vertical plane perpendicular to the imaginary vertical hosel plane, the exterior surface of the top portion includes a continuous straight segment bounded by a first endpoint and a second endpoint rearward of the first endpoint. An imaginary infinite straight line is collinear with the segment, but does not penetrate the exterior surface of the top portion.

These and other features and advantages of the golf club head according to the invention in its various aspects, as provided by one or more of the various examples described in detail below, will become apparent after consideration of the ensuing description, the accompanying drawings, and the appended claims. The accompanying drawings are for illustrative purposes only and are not intended to limit the scope of the present invention.

BRIEF DESCRIPTION OF THE DRAWINGS

The present invention, in one or more aspects thereof, is illustrated by way of example and not by way of limitation, in the figures of the accompanying drawings, where:

FIG. 1(*b*) is a bottom perspective view thereof;

FIG. 1(*c*) is a heel side view thereof;

FIG. 1(*d*) is a cross-sectional view in an imaginary vertical plane that extends through the face center of the golf club head of FIG. 1(*a*);

FIG. 1(*e*) is a cross-sectional view in the same plane as the view of FIG. 1(*d*) further illustrating one or more aspects of the present invention;

FIG. 1(*f*) is a detail of FIG. 1(*e*) further illustrating one or more aspects of the present invention;

FIG. 1(*g*) is a cross-sectional view in the same plane as the view of FIG. 1(*d*) and depicting further aspects of the present invention;

FIG. 1(*h*) is a side view of the golf club head of FIG. 1(*a*);

FIG. 1(*i*) is a front view of the golf club head of FIG. 1(*a*);

FIG. 1(*j*) is a front elevation view of the golf club head of FIG. 1(*a*) with a template applied thereto;

FIG. 2(*a*) is a top view thereof;

FIG. 2(*b*) is a cross-sectional view along the line 2(*b*)-2(*b*) of FIG. 2(*a*);

FIG. 2(*c*) is a cross-sectional view along the line 2(*c*)-2(*c*) of FIG. 2(*a*);

FIG. 2(*d*) is a cross-sectional view along the line 2(*d*)-2(*d*) of FIG. 2(*a*);

FIG. 2(*e*) is a heel side view of the golf club head of FIG. 2;

FIG. 3(*a*) is a heel side view thereof;

FIG. 3(*b*) is a top view thereof;

FIG. 3(*c*) is a cross-sectional view along the line 3(*c*)-3(*c*) of FIG. 3(*b*);

FIG. 3(*d*) is a cross-sectional view along the line 3(*d*)-3(*d*) of FIG. 3(*b*);

FIG. 3(*e*) is a cross-sectional view along the line 3(*e*)-3(*e*) of FIG. 3(*b*);

FIG. 4(*a*) is a side view thereof;

FIG. 4(*b*) is a top plan view thereof; and

FIG. 4(*c*) is a cross-sectional view in an imaginary vertical plane that extends through the face center of the golf club head of FIG. 4.

For purposes of illustration, these figures are not necessarily drawn to scale. In all the figures, same or similar elements are designated by the same reference numerals.

DETAILED DESCRIPTION

Figure 1A:
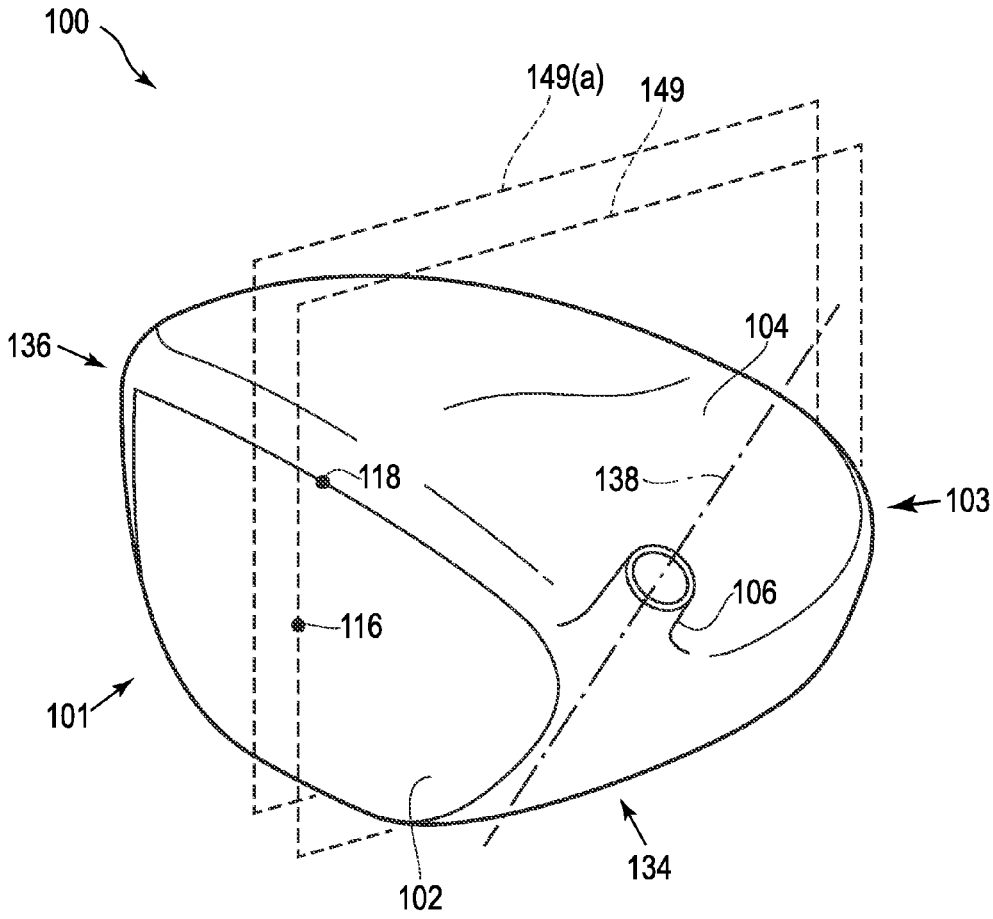
FIG. 1(*a*) is a heel-side perspective view of a golf club head according to one or more aspects of the present invention.
Figure 1B:
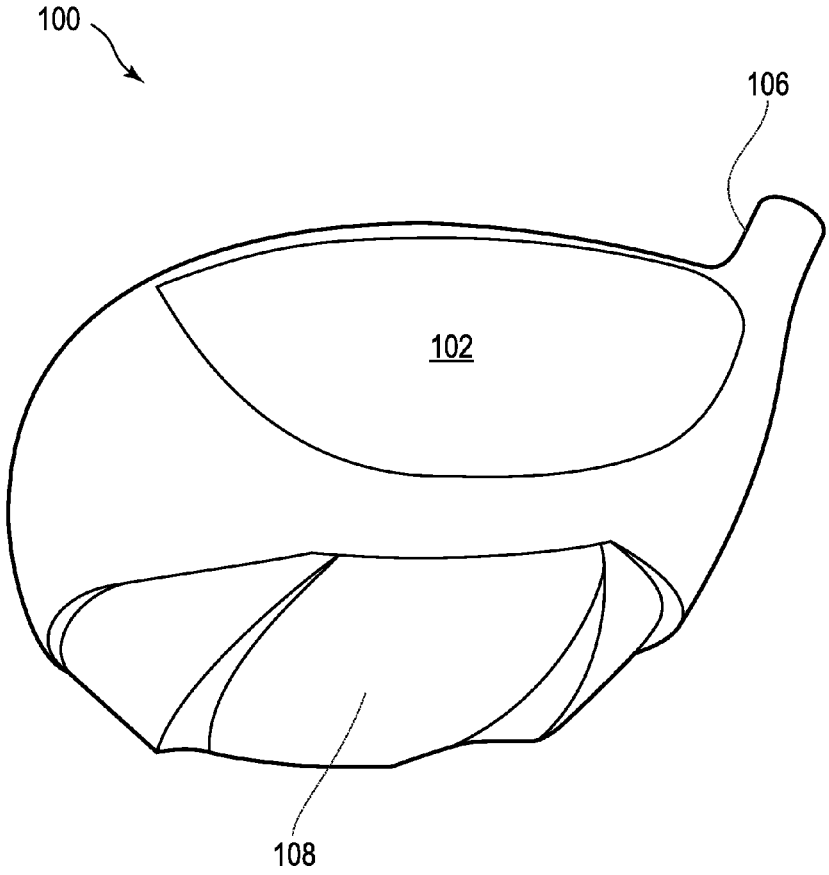
Figure 1C:
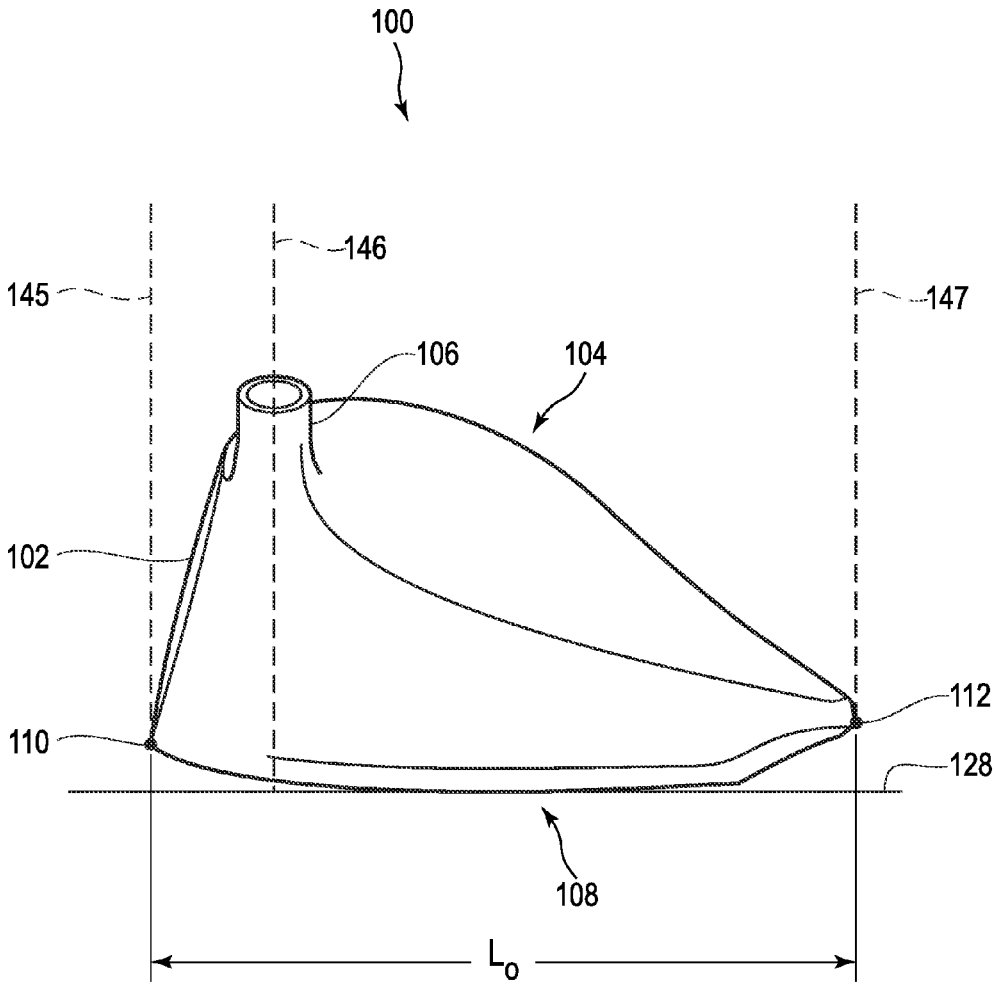
Figure 1D:
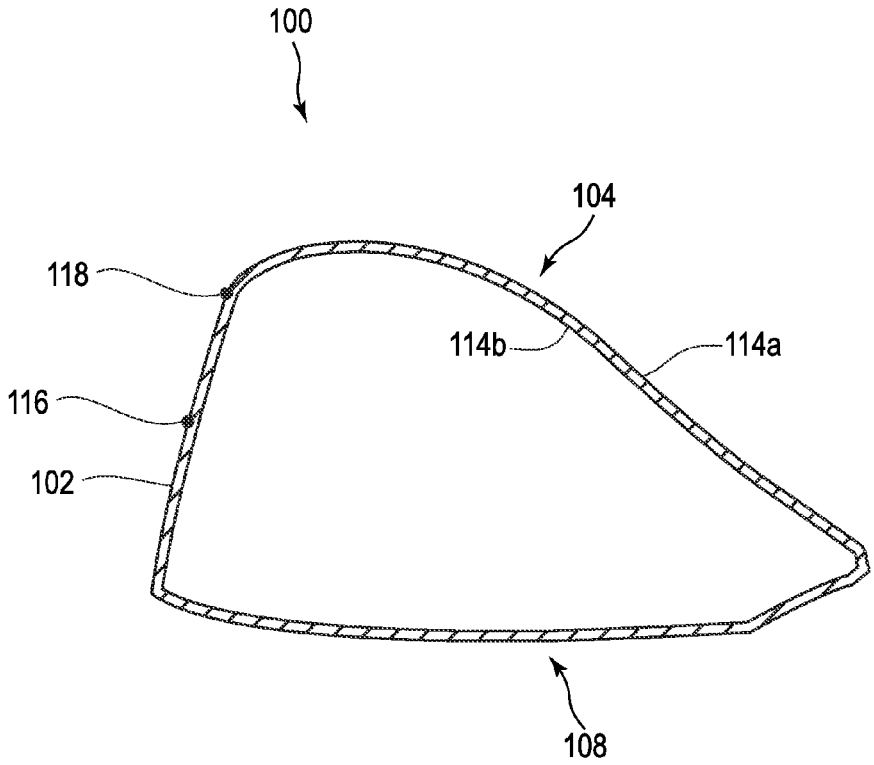
Figure 1E:
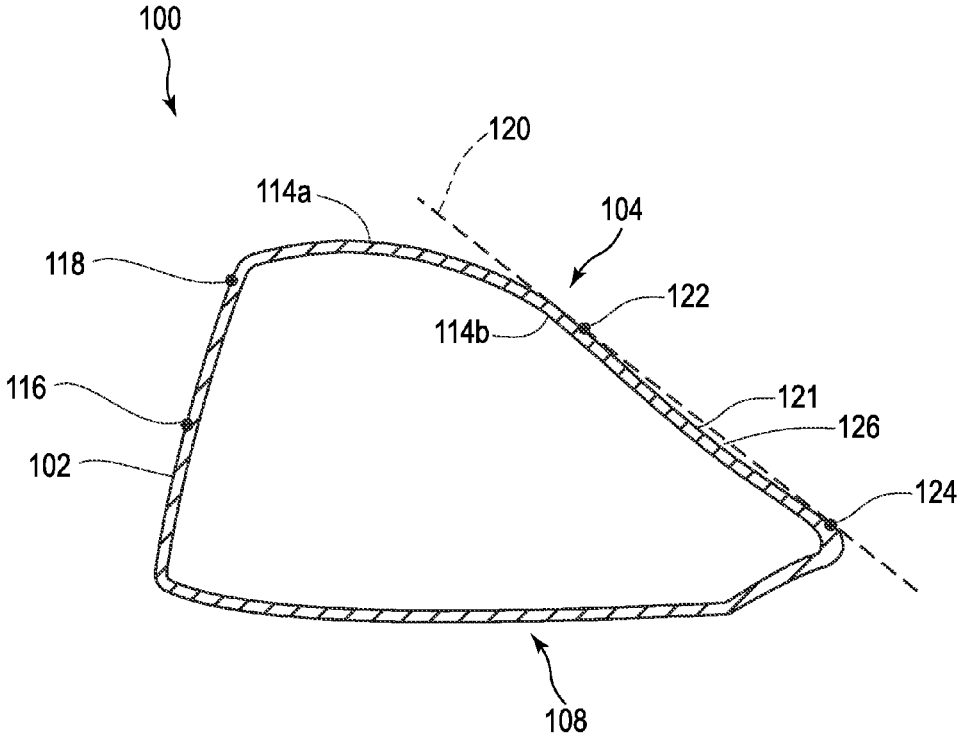
Figure 1F:
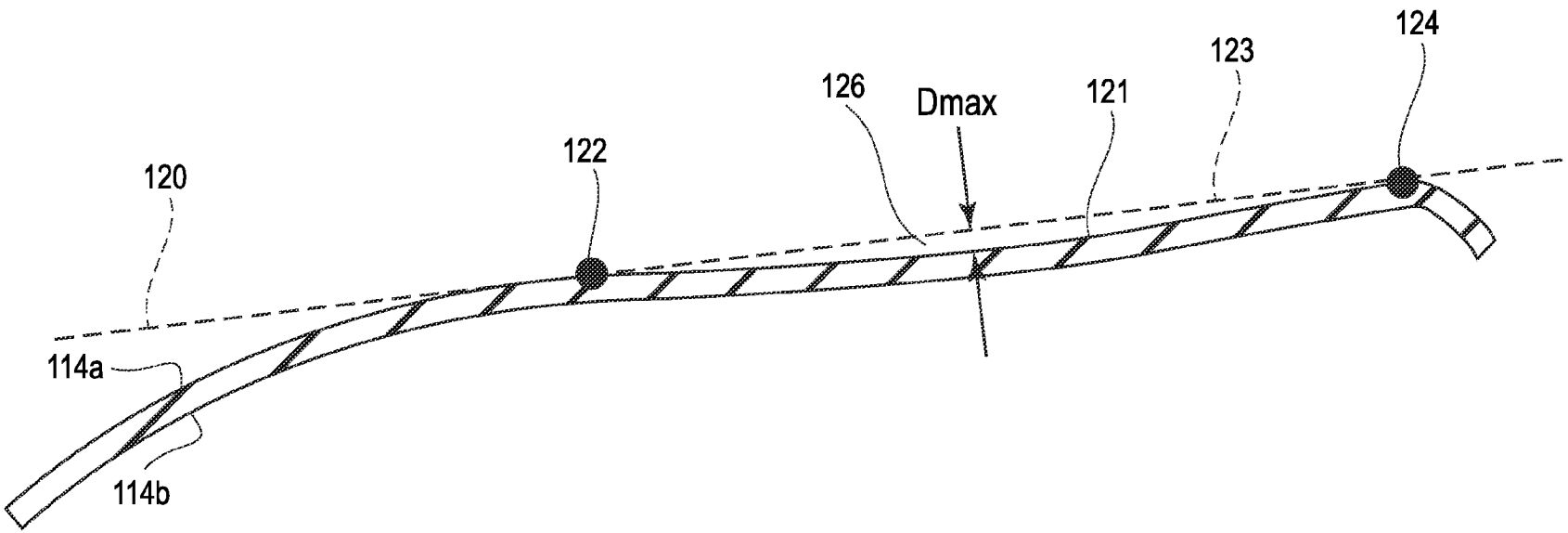
Figure 1G:
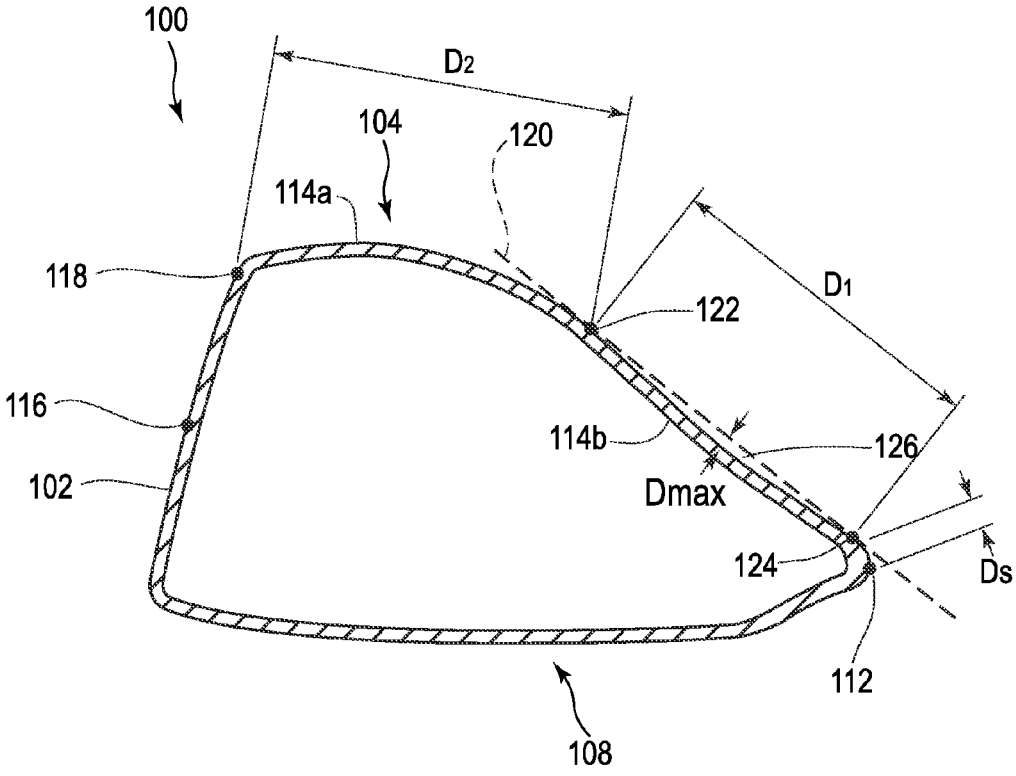
Figure 1H:
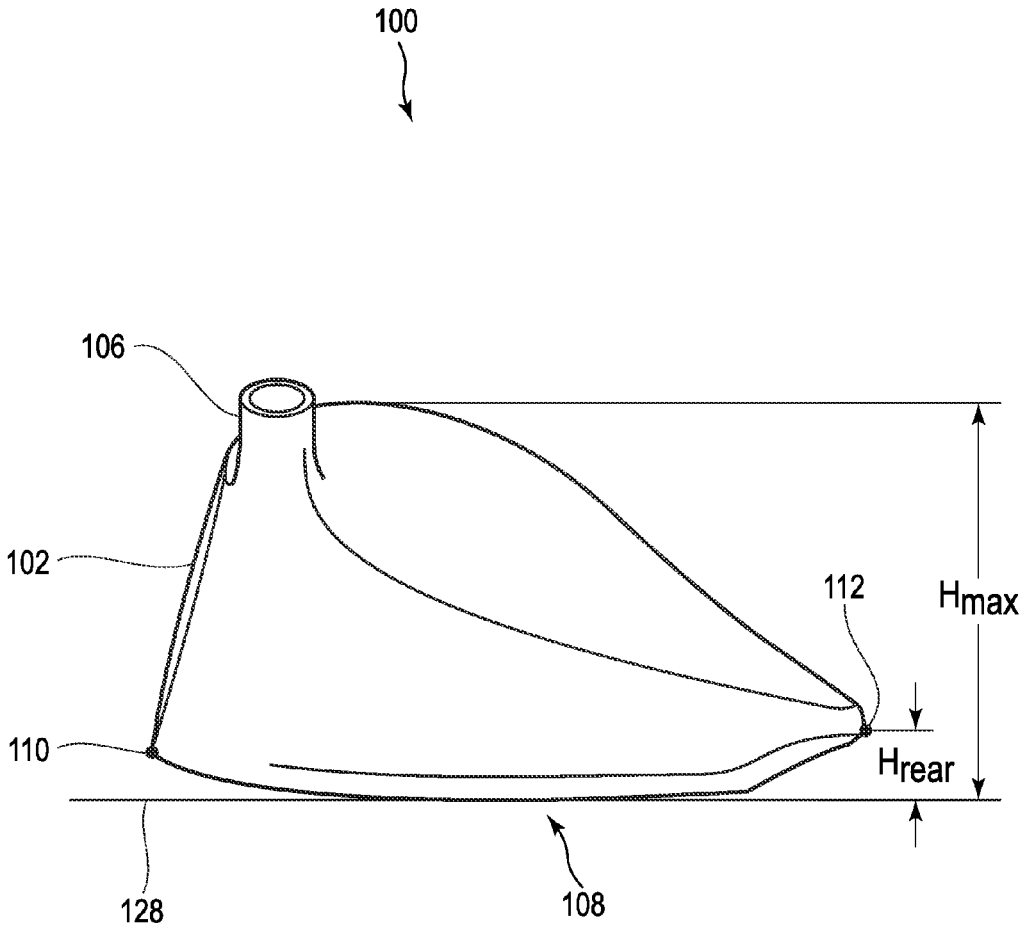
Figure 1I:
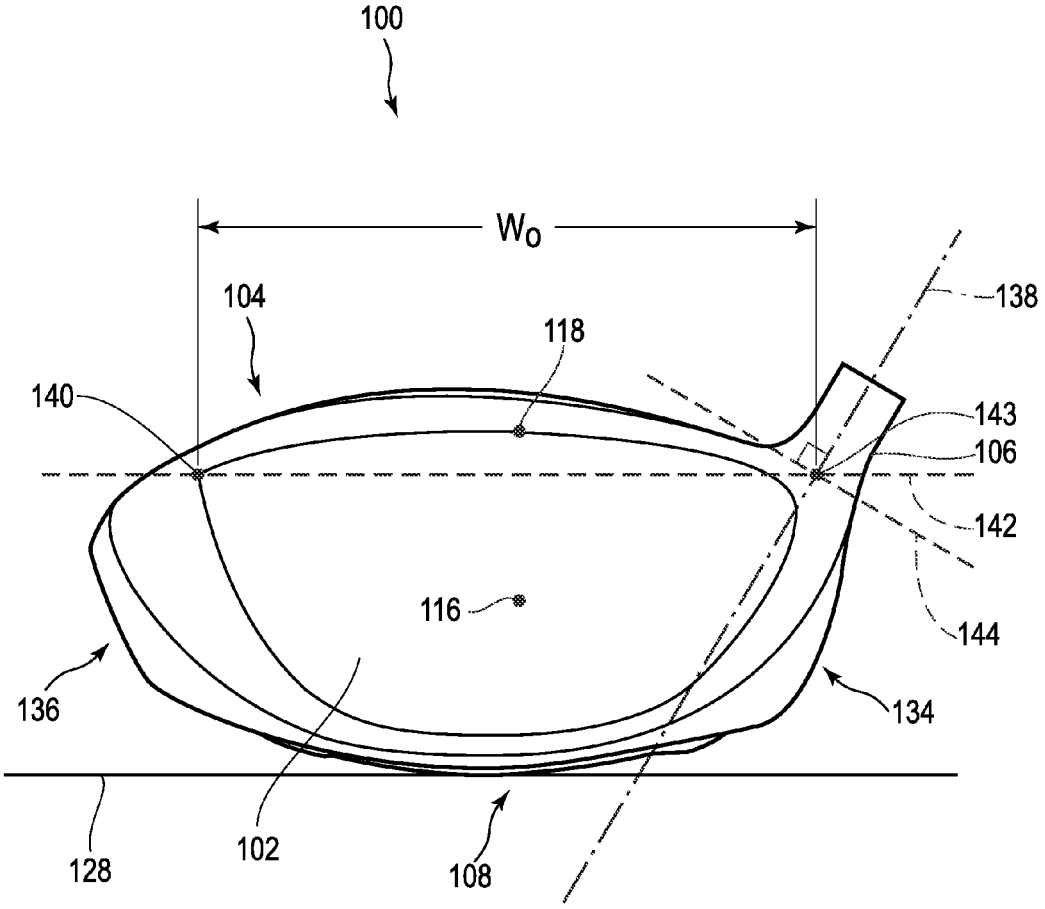
Figure 1J:
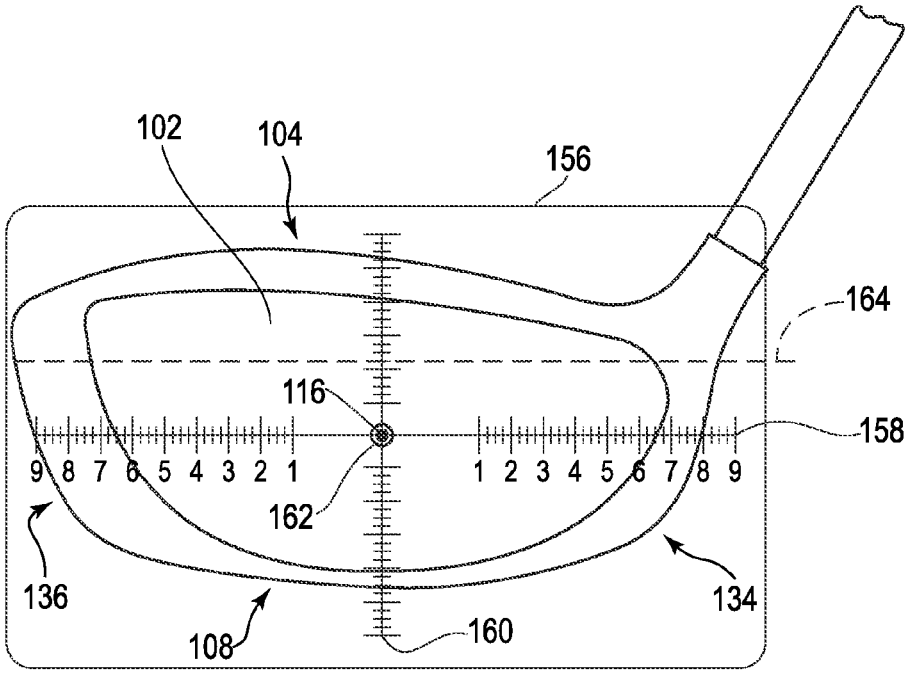

Representative examples of one or more novel and nonobvious aspects and features of the golf club head according to the present invention, disclosed below, are not intended to be limiting in any manner. Furthermore, the various aspects and features of the present invention may be used alone or in a variety of novel and nonobvious combinations and sub combinations with one another.

In one or more aspects of the present invention, and as depicted by way of example in FIG. 1(*a*) to FIG. 1(*j*), a golf club head 100 is a head for a wood-type golf club, such as a driver or a fairway wood. Referring, e.g., to FIGS. 1(*a*) and 1(*d*), the club head 100 has a front portion 101, including a striking face 102 for striking a golf ball; a rear portion 103 opposite the front portion 101; a top portion 104, including an exterior surface 114*a* and an interior surface 114*b*; a bottom portion 108, which is opposite the top portion 104; a heel portion 134; a toe portion 136 opposite the heel portion; and a hosel 106 at a heel side of the top portion 104 for receiving a shaft (not shown). The hosel 106, further defined below, has a hosel centerline 138. The golf club head 100 has an actual volume of at least about 150 cc. "Actual volume," as used herein, refers to the volume of the entire golf club head 100 including the hosel 106.

Referring to FIGS. 1(*c*) and 1(*i*), "reference position", as used herein, denotes a position of the club head 100 where the hosel centerline 138 is oriented at a lie angle $\alpha$ of 60° with respect to a horizontal ground plane 128 and lies in an imaginary vertical hosel plane 146, which contains an imaginary horizontal line, generally parallel to a striking face 102. Unless otherwise indicated, all parameters herein are specified with the club head in the reference position. Moreover, if not explicitly defined or explained otherwise, terms applied to the component parts of the various golf club heads set forth herein are to be construed as defined and explained when first introduced in this specification.

As shown in FIG. 1(*i*), the striking face 102 includes a front toe point 140. "Front toe point", e.g., the front toe point 140, as used herein, denotes the furthest laterally projecting point of the striking face 102 proximate the toe portion 136. An imaginary horizontal plane 142, passing through the front toe point 140, intersects the hosel centerline 138 at a point 143. "Hosel", e.g., the hosel 106, as used herein, denotes a portion of the club head 100 delimited from the rest of the head 100 by an imaginary plane 144, normal to the hosel centerline 138 and containing the point 143.

Referring once again to FIG. 1(*c*), the boundary between the striking face 102 and the bottom portion 108 includes a forwardmost point 110. The boundary between the top portion 104 and the bottom portion 108 includes a rearwardmost point 112 opposite the forwardmost point 110. An overall length $L_o$ of the club head 100 corresponds to a shortest distance between a first imaginary vertical plane 145, parallel to the imaginary vertical hosel plane 146 and passing through the forwardmost point 110, and a second imaginary vertical plane 147 parallel to the imaginary vertical hosel plane 146 and passing through the rearwardmost point 112. The length $L_o$ is greater than or equal to 90 mm, preferably greater than or equal to 100 mm, more preferably greater than or equal to 105 mm, and still more preferably greater than or equal to 110 mm. As employed herein, the phrases "greater than or equal to" and "not less than" are used interchangeably. Similarly, the phrases "less than or equal to" and "not greater than" are used interchangeably. Increasing the length $L_o$ of the club head to at least 90 mm allows the projected area of the head onto the ground plane to be enlarged, which in turn promotes a higher moment of inertia (MOI) of the club head, delivering improved performance, especially with respect to off-center shots.

Referring again to FIG. 1(*a*), the striking face 102 includes a face center 116 and a center apex 118. "Center apex", e.g., the center apex 118, as used herein, refers to a point of intersection between a third imaginary vertical plane 149, perpendicular to the imaginary vertical hosel plane 146 and passing through the face center 116, and a top of the striking face 102, with the club head 100 in the reference position.

Referring to FIG. 1(*j*), "face center", e.g., a face center 116, as used herein, is located using a template 156, having a coordinate system with a heel-toe axis 158 orthogonal to a top-bottom axis 160. An aperture 162 is disposed at the origin of the coordinate system and the axes 158, 160 are graduated into evenly spaced increments. The template 156 may be made of a flexible material, e.g., a transparent polymer.

The location of the face center 116 is determined as follows. The template 156 is initially applied to the striking face 102 so that the aperture 162 is approximately in the middle of the striking face 102 and the heel-toe axis 158 is generally parallel to an imaginary horizontal line 164. The template 156 is then translated in the heel-toe direction along the striking face 102 until the heel and the toe measurements along the axis 158 at the opposite edges of the striking face 102 have the same absolute value. Once the template 156 is centered with respect to the striking face 102 in the heel-toe direction, the template 156 is translated in the top-bottom direction along the striking face 102 until the measurements along the axis 160 at the opposite edges of the striking face 102 have the same absolute value. The above sequence is repeated until the absolute value of the heel measurement along axis 158 is equal to that of the toe measurement and the absolute value of the bottom measurement along axis 160 is equal to that of the top measurement. A point is then marked on the front surface through the aperture 162 to designate the face center 116.

A locating template, such as the template 156, is referenced in the United States Golf Association's Procedure for Measuring the Flexibility of a Golf Clubhead (Revision 2.0, Mar. 25, 2005) and is available from the USGA.

Referring now to FIG. 1(*e*), in the third imaginary vertical plane 149 or in a fourth imaginary plane 149(*a*), parallel to the plane 149 and intersecting the club head 100 (see FIG. 1(*a*)), the exterior surface 114*a* of the top portion 104 includes a path 121 bounded by a first point 122 and a second point 124, rearward of the first point 122. An imaginary infinite straight line 120 passes through the first point 122 and the second point 124, but does not penetrate the exterior surface 114*a* of the top portion 104. In one or more aspects of the present invention, the plane 149(*a*) is preferably spaced from the plane 149 a lateral distance less than or equal to 0.25 $W_o$, where $W_o$ is the overall width of the club head 100, as defined below. More preferably, plane 149(*a*) is spaced from the plane 149 less than or equal to 0.20 $W_o$ and still more preferably, less than or equal to 0.15 $W_o$.

Referring to FIG. 1(*f*), a segment 123 of the imaginary straight line 120 is delimited by the first point 122 and the second point 124. In addition, a two-dimensional space 126 is bounded by the segment 123 and the path 121. Those skilled in the art of golf club making will appreciate that points along the path 121 may or may not lie in a fully-recessed region of the exterior surface 114*a*. "Fully recessed region", as used herein, refers to a region of the exterior surface 114*a* of the top portion 104 consisting of all points on the exterior surface 114*a* of the top portion 104 such that every imaginary infinite straight line that passes through any one of such points also penetrates the exterior surface 114*a*.

A maximum distance, $D_{max}$, measured perpendicular to the imaginary straight line 120 between the segment 123 and the path 121, is less than or equal to 0.90 mm, preferably less than or equal to 0.80 mm, more preferably less than or equal to 0.70 mm, even more preferably less than or equal to 0.61 mm, yet more preferably less than or equal to 0.52 mm, and still more preferably less than or equal to 0.45 mm. Also, $D_{max}$ is preferably greater than or equal to 0.20 mm and more preferably greater than or equal to 0.30 mm. Limiting $D_{max}$ as disclosed above delivers a golf club head having enhanced MOI, a favorable dynamic-excitation response at impact with the ball, and a traditional shape when viewed at address by the player.

According to one or more aspects of the invention, a golf club head 100 has an adjusted volume greater than or equal to about 150 cc, more preferably greater than or equal to about 250 cc, even more preferably greater than or equal to about 320 cc, yet more preferably between about 400 and about 460 cc and, and still more preferably between about 420 and about 460 cc. The "adjusted volume" of a golf club head, as used herein, refers to the sum of the actual volume of the club head and the volume associated with any fully recessed region of the exterior surface of the top portion of the golf club head. The "volume associated with any fully recessed region," as used herein, refers to a volume consisting of all spatial points above the exterior surface 114*a* of the top portion 104 such that every imaginary infinite straight line that passes through any of such spatial points also penetrates the exterior surface 114*a* of the top portion 104. Those skilled in the art will appreciate that a fully recessed region may be continuous or discontinuous (i.e., comprising a plurality of discrete sub-regions).

Referring to FIG. 1(*g*), $D_1$ is a distance between the first point 122 and the second point 124. In one aspect of the present invention, $D_1$ is greater than or equal to 22 mm. Preferably, $D_1$ is greater than or equal to 25 mm, more preferably, $D_1$ is greater than or equal to 30 mm, yet more preferably, $D_1$ is greater than or equal to 35 mm, and still more preferably, $D_1$ is greater than or equal to 40 mm. Constraining $D_1$ within the above-recited ranges promotes advantages, such as the ability to maintain the club head's traditional shape when viewed at address by the golfer.

Referring again to FIG. 1(*g*), $D_2$ is a distance between the first point 122 and the location of the center apex 118 projected into the plane of the paper. $D_2$ is greater than or equal to 40 mm. Preferably, $D_2$ is between 50 and 100 mm. Still more preferably, $D_2$ is between 70 and 90 mm. Yet more preferably, $D_2$ is between 80 and 90 mm.

The distances $D_{max}$, $D_1$, and $D_2$ are related to each other as follows. $D_{max}/D_1$ is less than or equal to 0.035, preferably less than or equal to 0.030, more preferably less than or equal to 0.023, even more preferably less than or equal to 0.020, yet more preferably less than or equal to 0.018, still more preferably between 0.005 and 0.018, and yet still more preferably between 0.010 and 0.018.

$D_1/D_2$ is preferably less than or equal to 3.0, more preferably less than or equal to 2.5, still more preferably less than or equal to 2.0, and yet more preferably less than or equal to 1.5.

In one or more aspects of the present invention, $D_{max}$, $D_1$, and $D_2$ are particularly interrelated not only with each other, but also with the overall length $L_o$. Specifically, $D_2/L_o$ is preferably greater than or equal to 0.10, more preferably greater than or equal to 0.20, still more preferably greater than or equal to 0.30, and yet more preferably greater than or equal to 0.40. Based on practical considerations, $D_2/L_o$ is between 0.50 and 0.90 and preferably between 0.60 and 0.80. Delimiting $D_{max}$, $D_1$, $D_2$, and $L_0$ as described above promotes, among other advantages, the ability to maintain the club head's traditional shape when viewed at address by the golfer, thus promoting the player's confidence in the equipment.

Referring again to FIG. 1(*g*), to further promote the traditional appearance of the golf club head 100, a distance, $D_5$, between the second point 124 and the rearwardmost point 112 of the club head, projected into the plane of the paper, is set to be less than or equal to 45 mm, more preferably, less than or equal to 30 mm, still more preferably, less than or equal to 20 mm, and yet more preferably less than or equal to 15 mm.

Referring again to FIG. 1(*i*), the "overall width," or "$W_o$," as used herein, denotes a distance between the front toe point 140 and the point 143 of the golf club head 100. $W_o$ is related to the projected area of the club head 100 onto the ground plane. To promote increased MOI of the club head 100, the width $W_o$ is preferably greater than or equal to 3 inches, more preferably greater than or equal to 3.5 inches, and still more preferably greater than or equal to 4 inches.

Referring to FIG. 1(*h*), the top portion 104 of the golf club head 100 has a maximum height $H_{max}$. "Maximum height," or "$H_{max}$," of the top portion 104, as used herein, refers to the maximum vertical distance between the ground plane 128 and the exterior surface 114*a* of the top portion 104, with the club head 100 in the reference position. Preferably, $H_{max}$ is less than or equal to 2.8 in.

Referring again to FIG. 1(*h*), the "height of the rearwardmost point," or "$H_{rear}$," as used herein, refers to a vertical distance between the ground plane 128 and the rearwardmost point 112 of the club head 100, with the club head 100 in the reference position. $H_{rear}/H_{max}$ is preferably less than or equal to 0.50, more preferably less than or equal to 0.40, still more preferably less than or equal to 0.30, and yet more preferably less than or equal to 0.25. Most preferably, $H_{rear}/H_{max}$ is between 0.10 and 0.22. The advantageous relationships between $H_{rear}$ and $H_{max}$, disclosed above, help maintain the club head's traditional shape when viewed at address by the golfer.

Figure 2:
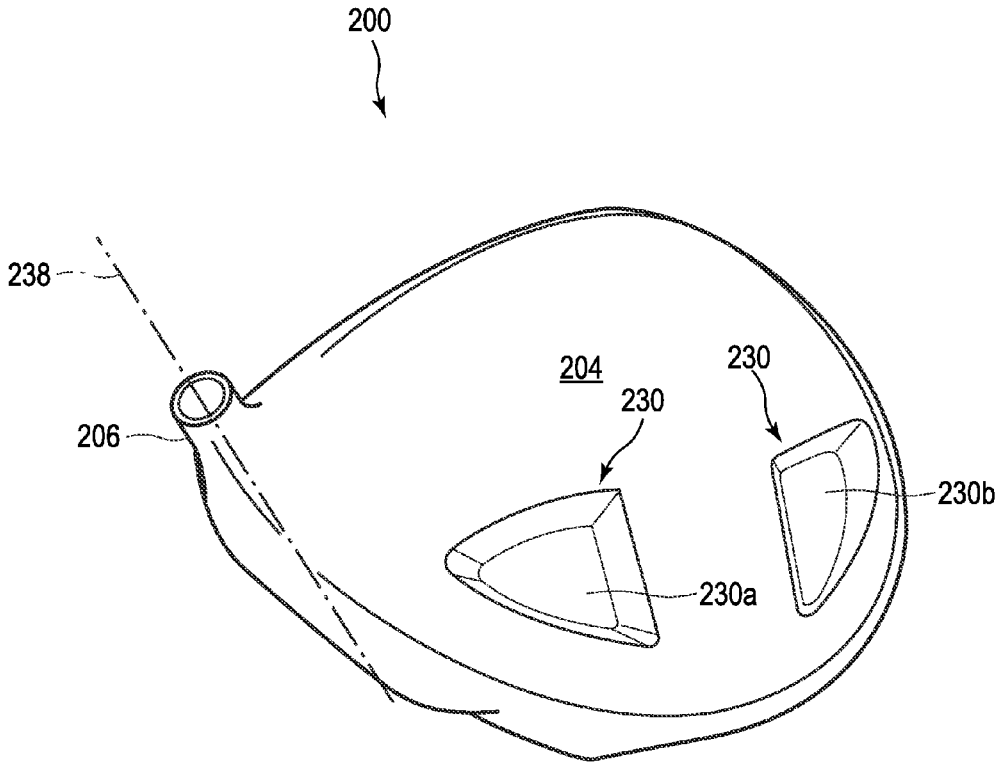
FIG. 2 is a rear perspective view of a golf club head according to one or more aspects of the present invention.
Figure 2A:
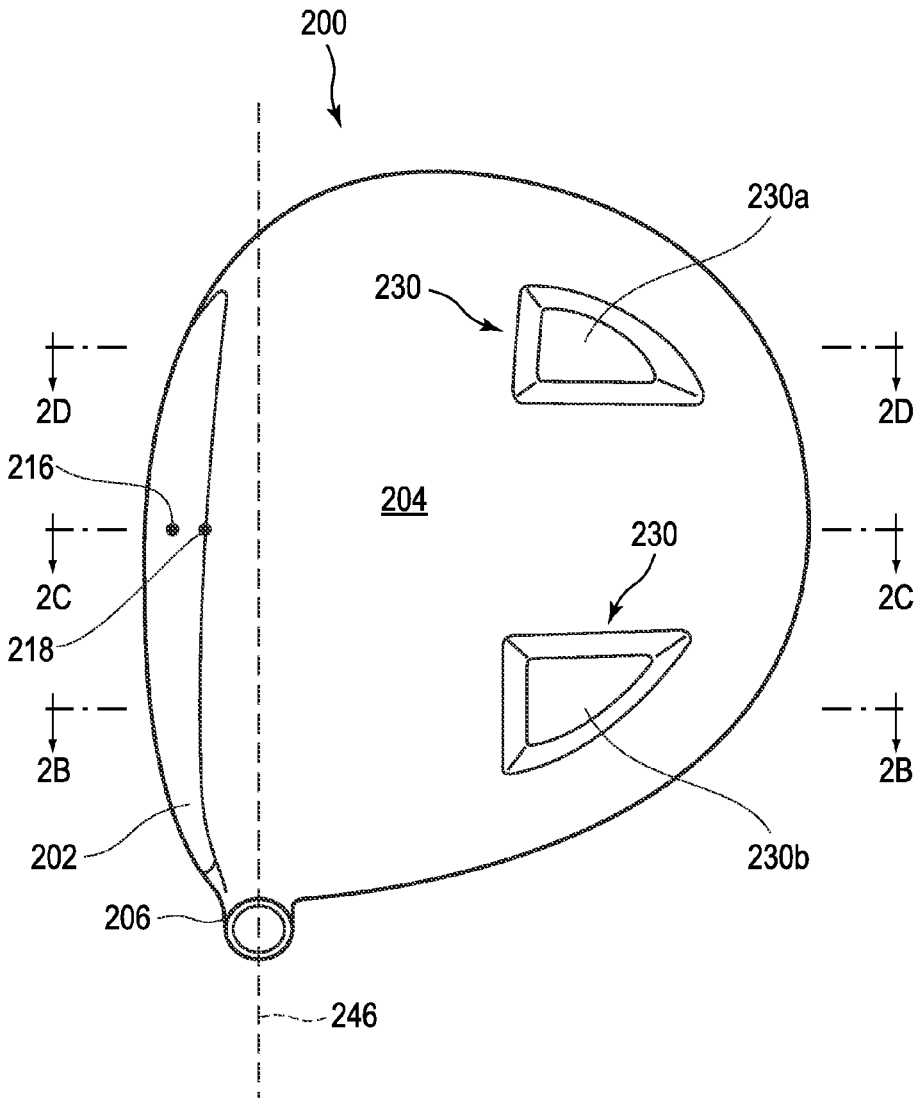
Figure 2B:
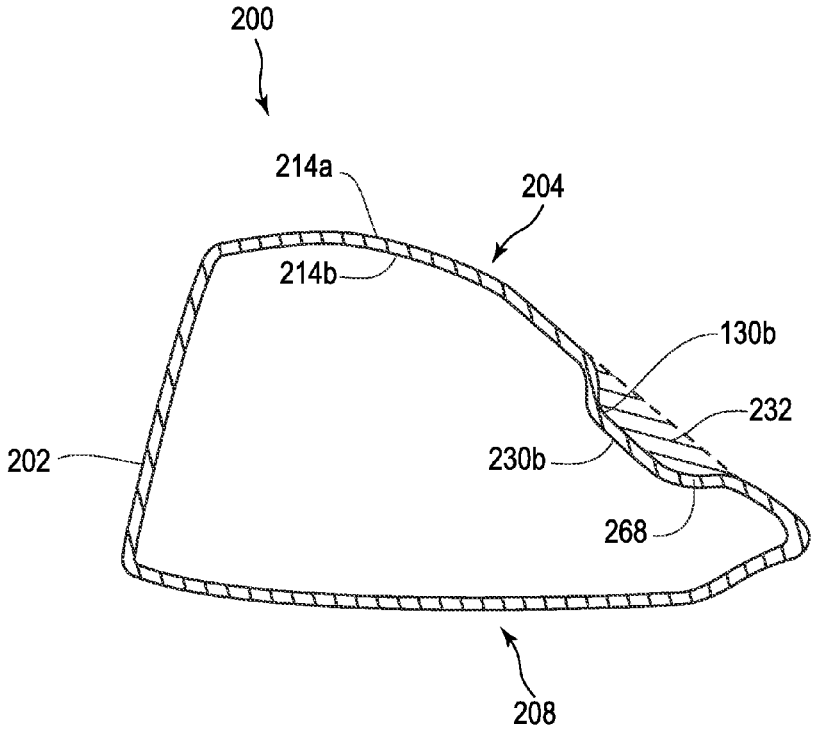
Figure 2C:
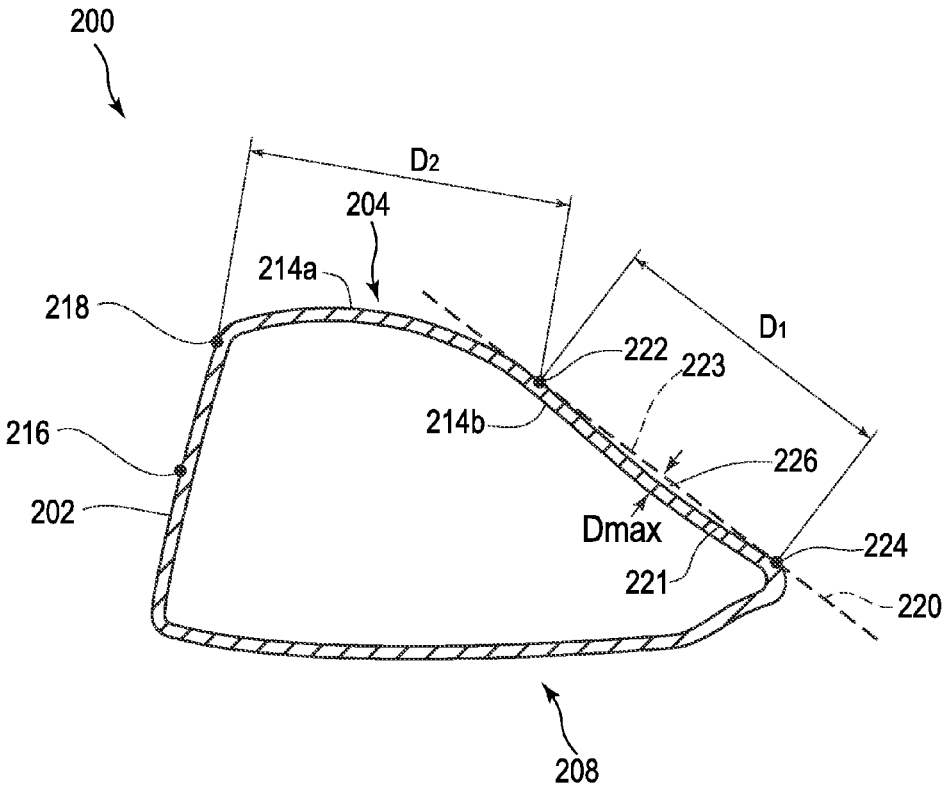
Figure 2D:
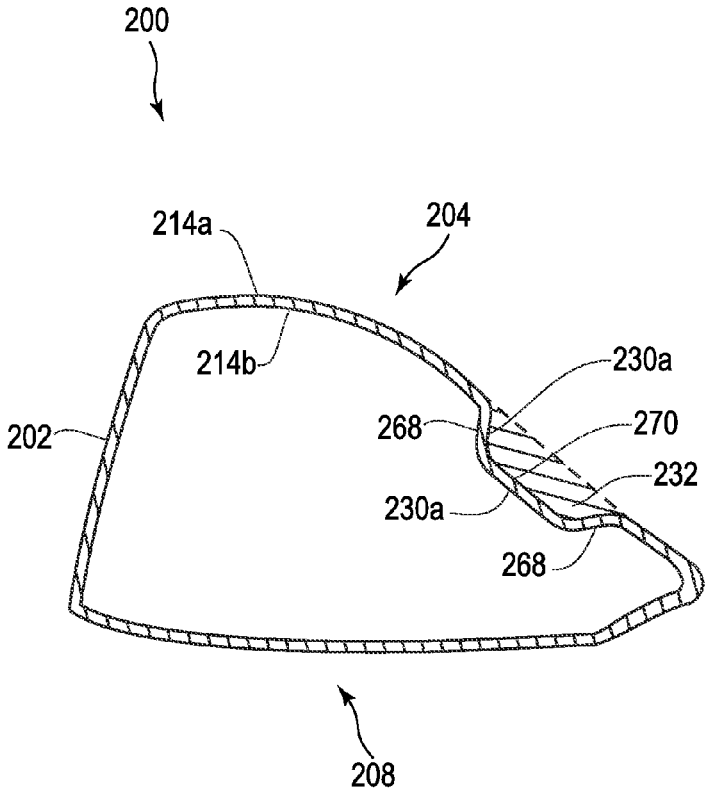
Figure 2E:
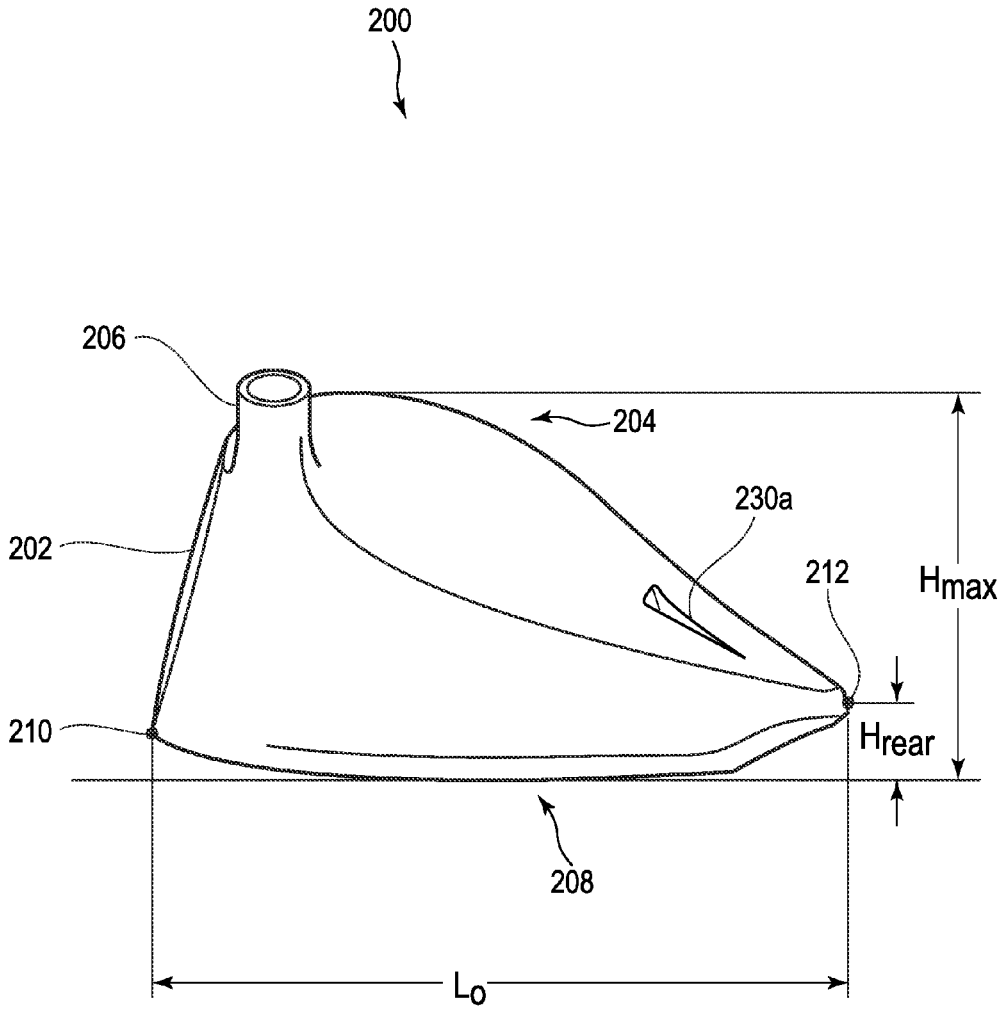

In one or more aspects of the present invention, as shown in FIGS. 2-2(*e*), a golf club head 200 includes a top portion 204, a bottom portion 208, a striking face 202 having a face center 216 and a center apex 218, and a hosel 206 having an imaginary vertical hosel plane 246 containing a hosel centerline 238. The top portion 204 includes an exterior surface 214*a* having a fully-recessed region 230. Apart from the fully-recessed region 230, the golf club head 200 may have aspects same or similar to the aspects of the present invention shown in FIGS. 1(*a*)-1(*j*).

The fully-recessed region 230 consists of all points on the exterior surface 214*a* of the top portion 204 located such that every imaginary infinite straight line that passes through any one of such points also penetrates the exterior surface 214*a* of the top portion 204. The fully-recessed region 230 has an associated volume 232 (see, e.g., FIG. 2(*b*)) consisting of all spatial points above the top portion 204 of the club head 200 located such that every imaginary infinite straight line that passes through any one of such spatial points also penetrates the exterior surface 214*a* of the top portion 204. The associated volume of the fully-recessed region 230 of the golf club head 200 is preferably less than or equal to 4 cc, more preferably less than or equal to 2 cc, even more preferably less than or equal to 1 cc, and yet even more preferably less than or equal to 0.1 cc. In one or more aspects of the present invention, the fully-recessed region 230 comprises a surface area less than or equal to 6 $cm^2$, more preferably less than or equal to 3 $cm^2$, even more preferably less than or equal to 1 $cm^2$, yet even more preferably less than or equal to 0.5 $cm^2$. These ranges are advantageous in reducing the disparity between an adjusted volume of the golf club head 200 and an actual volume of the golf club head 200, as defined above. Thus, mass of the golf club head 200 may be more strategically placed, e.g., for enhancing the moment of inertia of the golf club head 200. In one or more aspects of the present invention, as shown, e.g., in FIG. 2(*a*), the fully-recessed region 230 comprises discrete sub-regions 230*a*, 230*b*.

FIGS. 2(*b*)-2(*d*) each show the golf club head 200 in a cross-section taken at one of three parallel, spaced apart cross-sections, as shown in FIG. 2(*a*). Vertical cross-sections 2(*b*) and 2(*d*) are perpendicular to a hosel plane 246 and pass through sub-regions 230*b* and 230*a* of the fully-recessed region 230, respectively. Vertical cross-section 2(*c*) is also perpendicular to the hosel plane 246, but passes through the center apex 218.

Referring to FIG. 2(*c*), the exterior surface 214*a* of the top portion 204 includes a path 221 bounded by a first point 222 and a second point 224 rearward of the first point 222. The path 221 is same or similar to the path 121 as shown in FIG. 1(*f*). An imaginary infinite straight line 220 passes through the first point 222 and the second point 224, but does not penetrate the exterior surface 214*a* of the top portion 204. A segment 223 of the imaginary straight line is delimited by the first point 222 and the second point 224. A two-dimensional space 226 is bounded by the first point 222, the second point 224, the path 221, and the imaginary infinite straight line 220, such that a maximum distance, $D_{max}$, measured perpendicular to the imaginary straight line 220, between the segment 223 and the exterior surface 214*a* of the top portion 204 is less than or equal to 0.90 mm. This maximum distance is more preferably less than or equal to 0.80 mm. Also, a distance $D_1$ denotes the shortest distance between the first point 222 and the second point 224. A distance $D_2$ denotes the shortest distance between the first point 222 and the center apex 218. The distances $D_1$ and $D_2$ are similar to the distances $D_1$ and $D_2$ as shown in FIG. 1(*g*).

Referring to FIG. 2(*e*), the golf club head 200 further includes a forwardmost point 210 and a rearwardmost point 212. A maximum height of the top portion 204 of the golf club head 200, $H_{max}$, and the height of the rearwardmost point 212 of the golf club head 200, $H_{rear}$, are same or similar to the $H_{max}$ and $H_{rear}$ as shown in FIG. 1(*h*).

Figure 3:
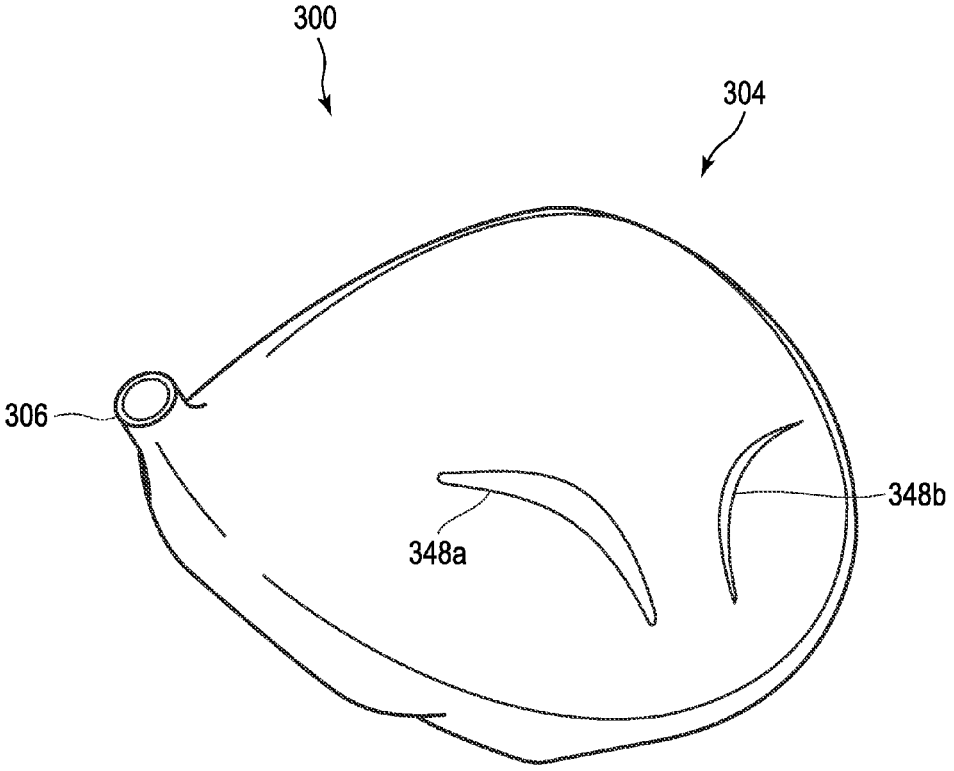
FIG. 3 is a rear perspective view of a golf club head according to one or more aspects of the present invention.
Figure 3A:
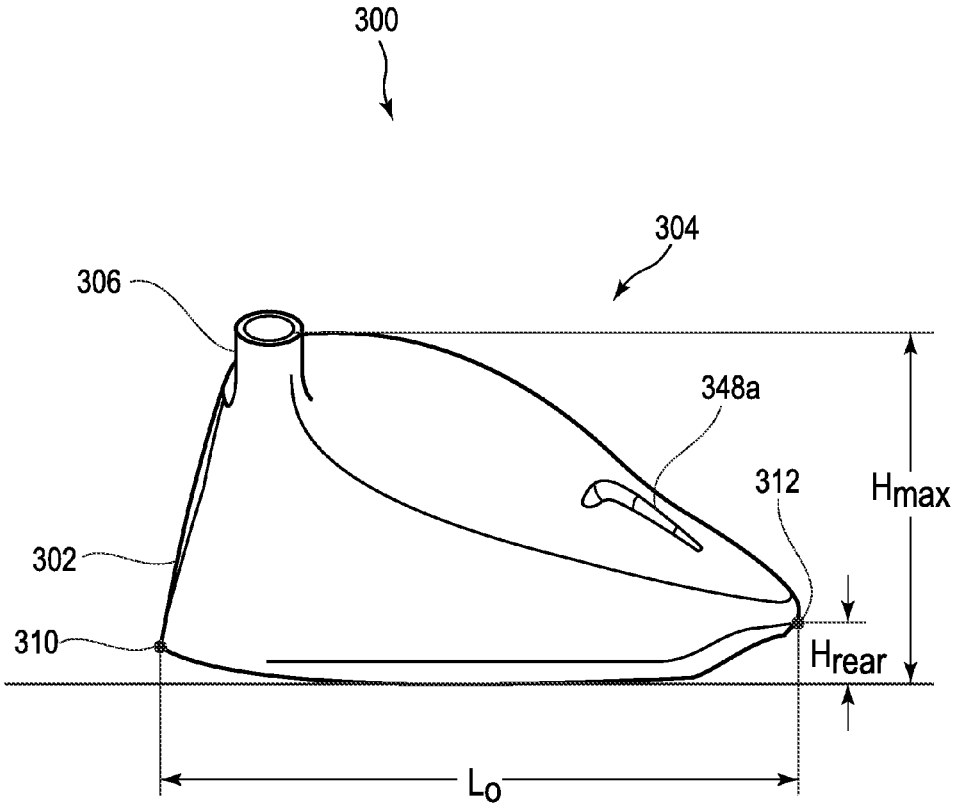
Figure 3B:
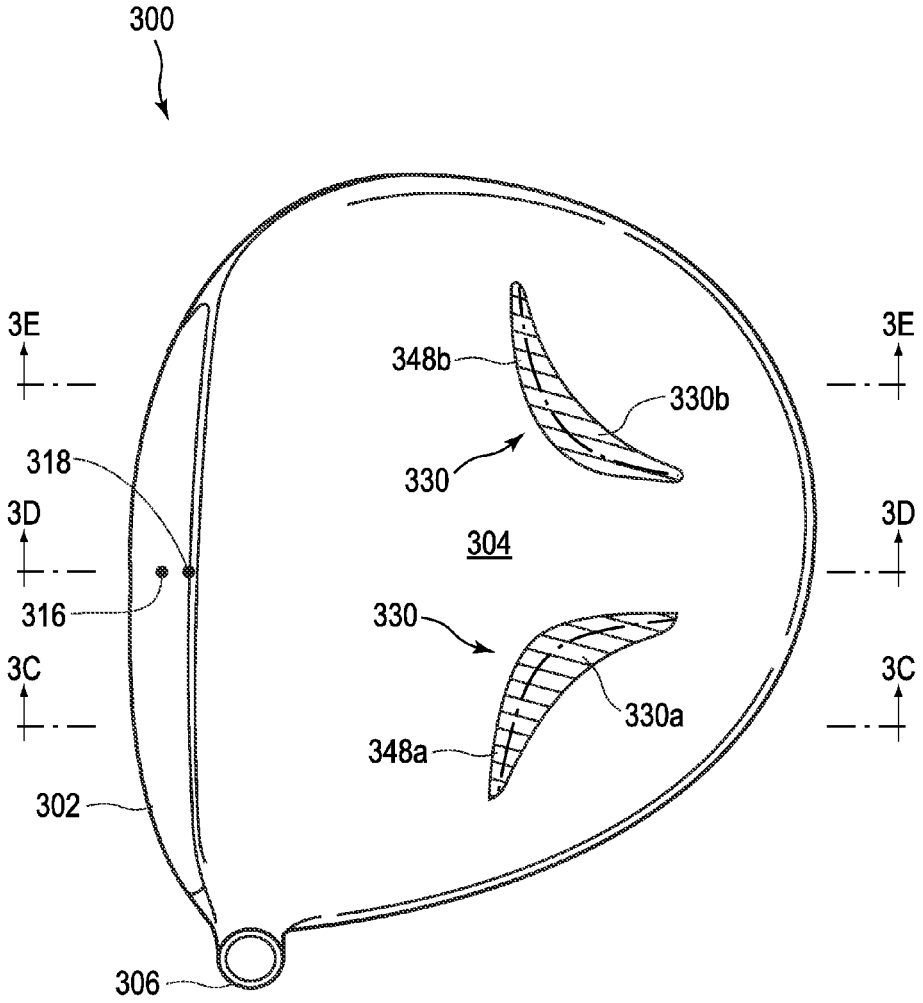
Figure 3C:
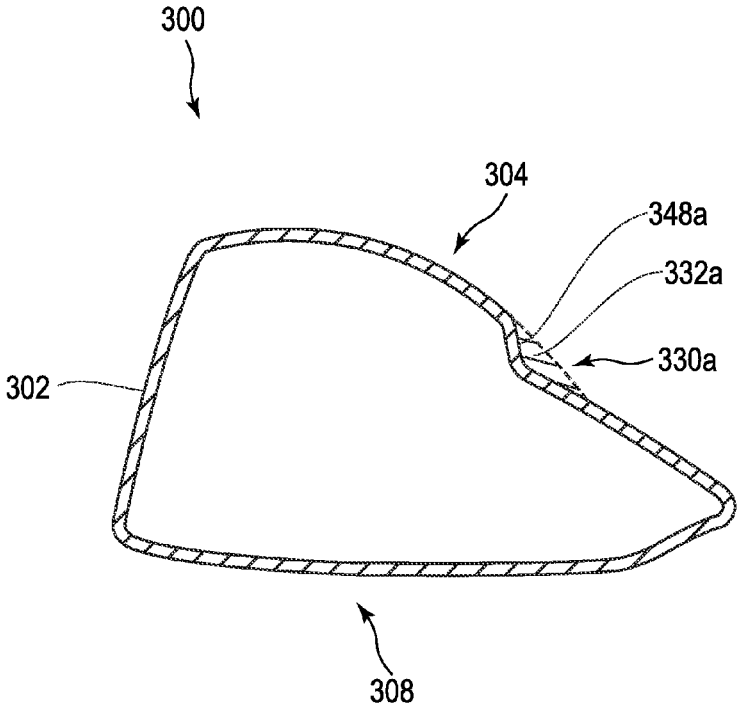
Figure 3D:
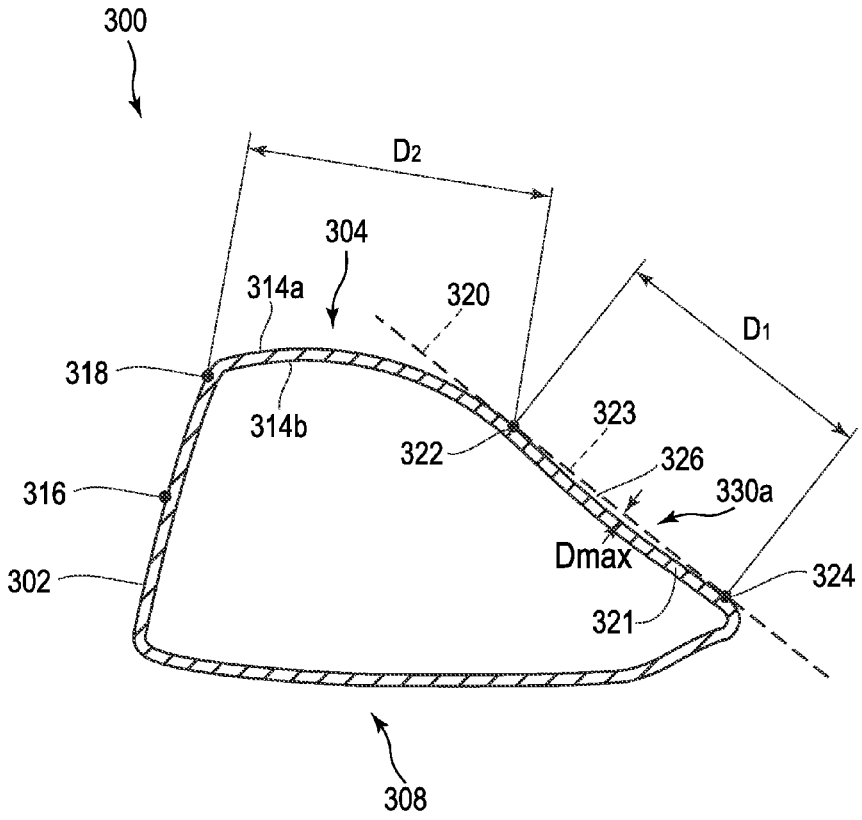
Figure 3E:
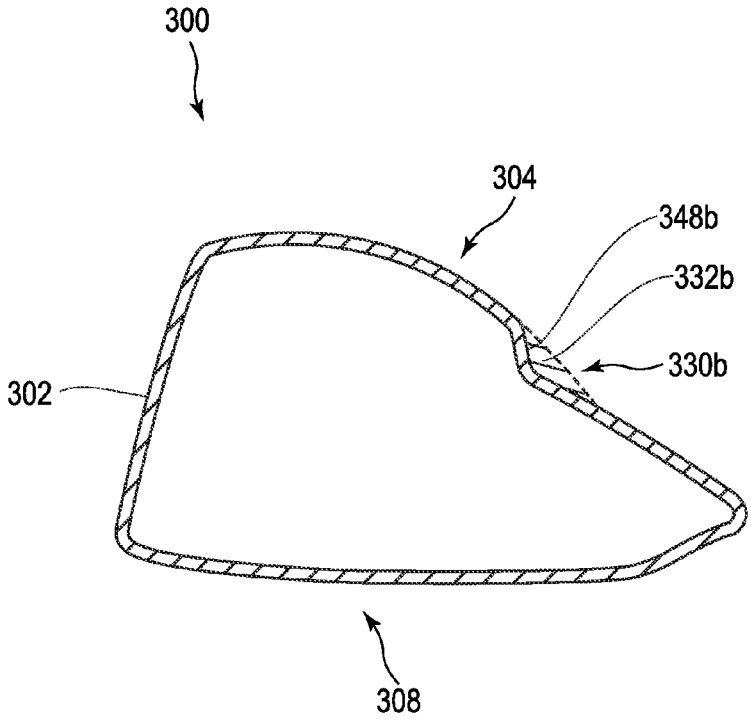

In one or more aspects of the present invention, referring to FIGS. 3-3(*e*), a golf club head 300 includes a top portion 304 having contour features 348*a*, 348*b*. In other respects, the golf club head 300 may be the same or identical to the aspects of the present invention illustrated, e.g., in FIGS. 1(*a*)-1(*j*). The contour features 348*a*, 348*b* form a fully-recessed region 330 having sub-regions 330*a*, 330*b* (see FIG. 3(*b*)). Specifically, the sub-region 330*a* of the fully-recessed region 330 includes a portion of the exterior surface 314*a* corresponding to the contour feature 348*a* and a portion of the exterior surface 314*a* generally rearward of the contour feature 348*a*. Likewise, the sub-region 330*b* of the fully-recessed region 330 includes a portion of the exterior surface 314*a* corresponding to the contour feature 348*b* and a portion of the exterior surface 314*a* generally rearward of the contour feature 348*b*.

The fully-recessed region 330 has a surface area similar to the surface area of the fully-recessed region 230 shown in FIG. 2(*a*). A volume 332 is associated with the fully-recessed region 330 and is similar to the volume 132 associated with the fully-recessed region 230 shown in FIG. 2(*a*). The volume 332 comprises a discrete sub-volume 332*a* associated with the sub-region 330*a*, and a discrete sub-volume 332*b* associate with the sub-region 330*b*.

Referring specifically to FIG. 3(*d*), the exterior surface 314*a* of the top portion 304 forms a path 321 bounded by a first point 322 and a second point 324 rearward of the first point 322. The path 321 is same or similar to the path 121 shown in FIG. 1(*f*). An imaginary infinite straight line 320 passes through the first point 322 and the second point 324, but does not penetrate the exterior surface 314*a* of the top portion 304. A segment 323 of the imaginary straight line 320 is delimited by the first point 322 and the second point 324. A two-dimensional space 326 is bounded by the first point 322, the second point 324, the path 321, and the imaginary infinite straight line 320, such that a maximum distance, $D_{max}$, measured perpendicular to the imaginary straight line 320, between the segment 323 and the path 321 is less than or equal to 0.90 mm, more preferably less than or equal to 0.80 mm. Limiting $D_{max}$ as disclosed above delivers a golf club head having enhanced MOI, a favorable dynamic-excitation response at impact with the ball, and a traditional shape when viewed at address by the player.

Referring again to FIG. 3(*d*), a distance $D_1$ denotes the shortest distance between the first point 322 and the second point 324. A distance $D_2$ denotes the shortest distance between the first point 322 and the center apex 318. The distances $D_1$ and $D_2$ of the golf club head 300 are similar to the distances $D_1$ and $D_2$ of the golf club head 100 shown in FIG. 1(*g*).

Figure 4:
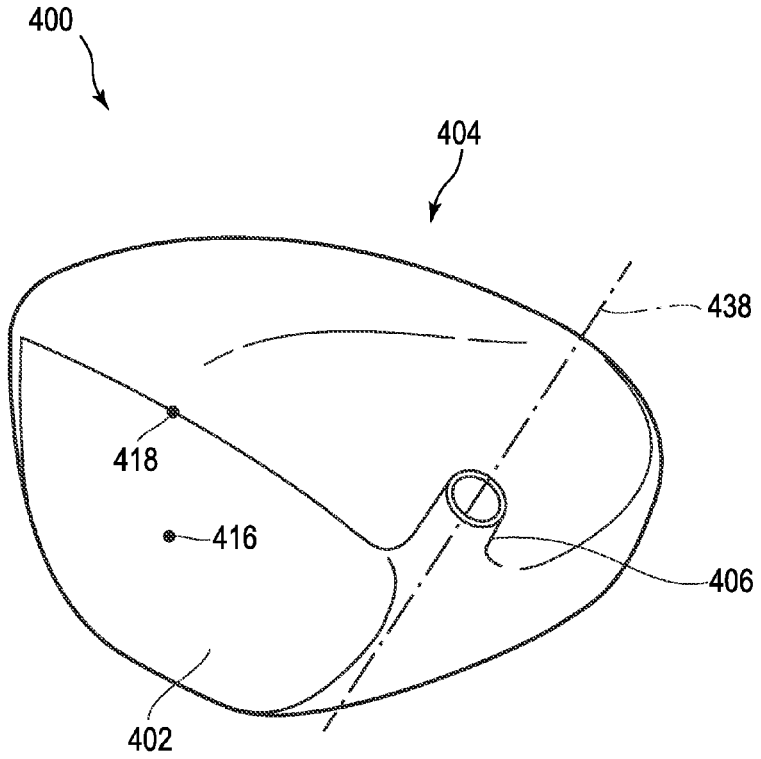
FIG. 4 is a heel-side perspective view of a golf club according to one or more aspects of the present invention.
Figure 4A:
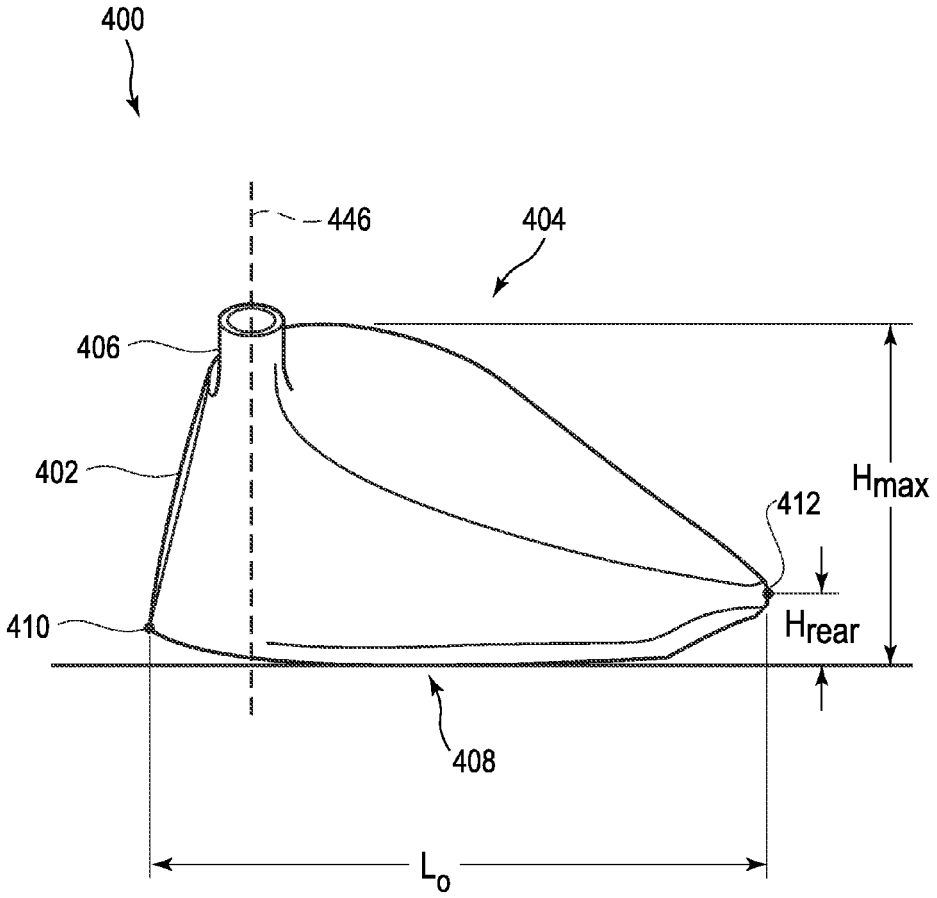
Figure 4B:
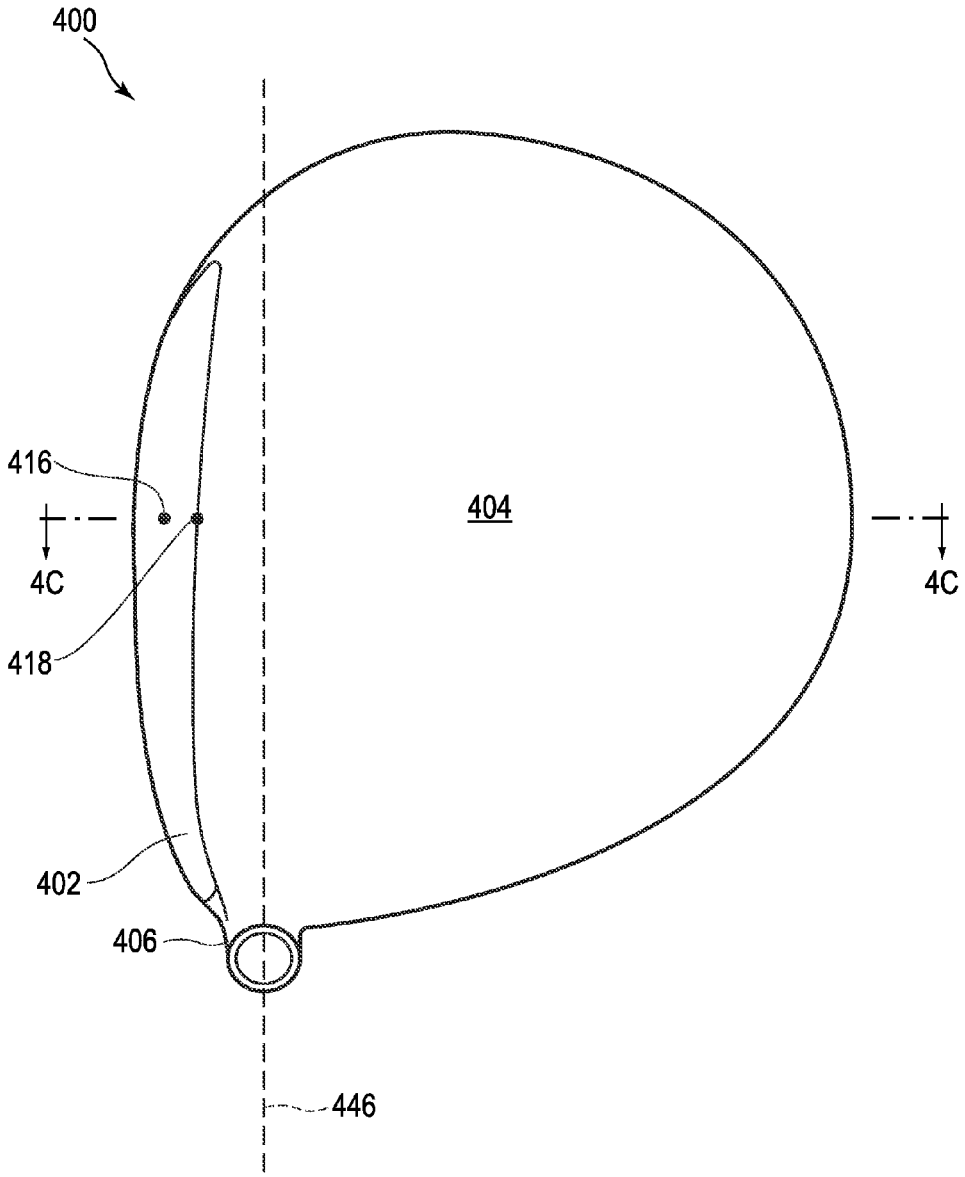
Figure 4C:
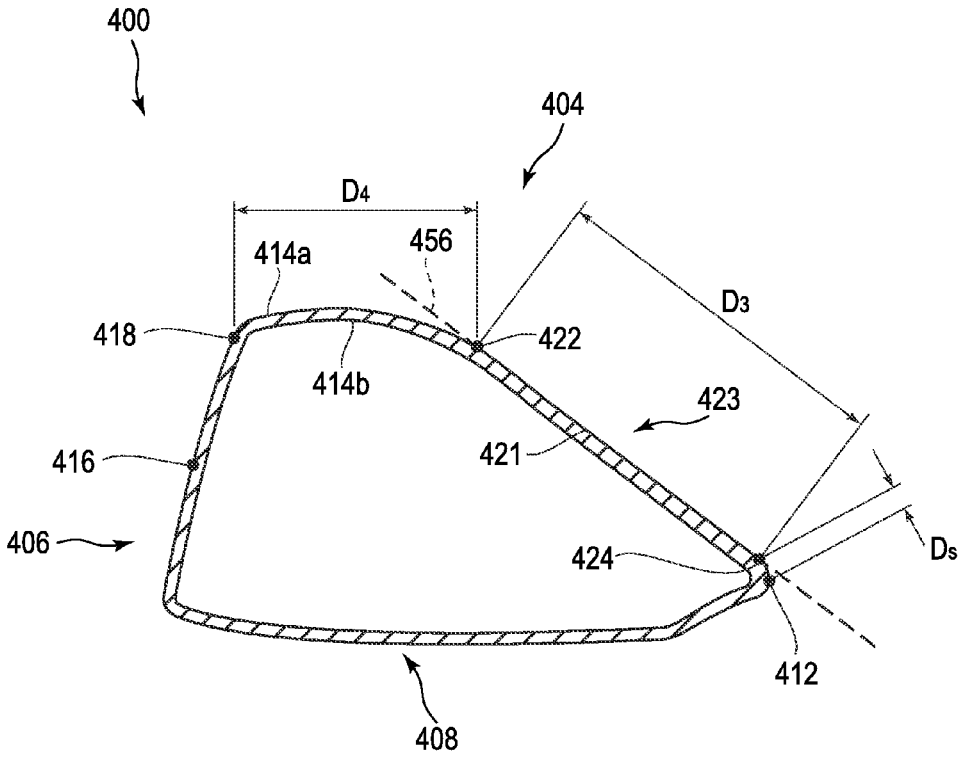

In one or more aspects of the present invention, referring to FIGS. 4-4(*c*), a golf club head 400 comprises a wood-type golf club head. Referring to FIG. 4, the golf club head 400 includes a top portion 404, a bottom portion 408 (see FIG. 4(*a*)), a striking face 402 having a face center 416 and a center apex 418, and a hosel 406 having a hosel centerline 438 and an imaginary vertical hosel plane 446 containing the hosel centerline 438 (see FIGS. 4 and 4(*b*)). Referring to FIG. 4(*a*), the golf club head 400 further includes a forwardmost point 410 and a rearwardmost point 412 located opposite the forwardmost point 410. The golf club head 400 preferably has a volume greater than or equal to about 150 cc, more preferably greater than or equal to about 250 cc, yet more preferably greater than or equal to about 320 cc.

Referring to FIG. 4(*b*), a vertical cross-section 4(*c*) passes through a portion of the club head 400 and is perpendicular to the imaginary vertical hosel plane 446. As shown, the cross-section 4(*c*) passes through the center apex 418. However, in one or more alternative aspects of the present invention, the cross-section 4(*c*) may be laterally offset from the center apex 418, e.g., by a distance of no greater than 0.25 times an overall width, $W_o$, of the club head 400.

Referring to FIG. 4(*c*), the golf club head 400 is shown in cross-section 4(*c*). The top portion 404 includes an exterior surface 414*a* and an opposing interior surface 414*b*. As shown, the exterior surface 414*a* forms a path 421 that constitutes a straight line segment 423. Specifically, the segment 423 is bounded by a first end point 422 and a second end point 424, which is rearward of the first endpoint 422. In the cross-section 4(*c*), an imaginary infinite straight line 456 is collinear with the straight line segment 423, but does not penetrate the exterior surface 414*a* of the top portion 404. Distance $D_3$ denotes the shortest distance between the first end point 422 and the second end point 424. $D_4$ denotes the distance between the first end point 422 and the center apex 418, projected into the plane of cross-section 4(*c*). $D_3$ is preferably greater than or equal to 4 mm, more preferably greater than or equal to 8 mm.

Referring again to FIG. 4(*a*), with the golf club head 400 in the reference position, the rearwardmost point 412 comprises a height, $H_{rear}$, and the top portion 404 of the golf club head 400 comprises a maximum height, $H_{max}$. The ratio $H_{rear}/H_{max}$ is preferably less than or equal to 0.50, more preferably less than or equal to 0.40, most preferably less than or equal to 0.25.

Referring again to FIG. 4(*c*), a distance $D_5$, in the cross-section 4(*c*), between the second endpoint 424 and the rearwardmost point 412, projected into the plane of the cross-section 4(*c*), is preferably less than or equal to 45 mm, more preferably less than or equal to 25 mm, even more preferably less than or equal to 15 mm, and yet even more preferably less than or equal to 10 mm. Limiting the distance $D_5$ as disclosed above delivers a golf club head having enhanced MOI, a favorable dynamic-excitation response at impact with the ball, and a traditional shape when viewed at address by the player.

Referring to FIGS. 4(*a*) and 4(*c*), the golf club head 400 includes an overall length $L_o$ that is same or similar to the overall length $L_o$ as shown in FIG. 1(*c*). A ratio $D_4/L_o$ is preferably greater than or equal to 0.35, more preferably greater than or equal to 0.45, even more preferably greater than or equal to 0.50.

Those skilled in the art will appreciate that while the present invention has been described in association with presently preferred aspects thereof, numerous changes, modifications and substitutions of equivalents may be made therein without departing from the spirit and scope of this invention which is intended to be unlimited by the foregoing except as may appear in the following appended claims.

We claim:

1. A golf club head that, when oriented in a reference position, comprises:

a striking face including a face center and a center apex;

a bottom portion and a top portion opposite the bottom portion, the top portion including an exterior surface;

a hosel including an imaginary centerline and an imaginary vertical hosel plane containing the imaginary centerline;

a forwardmost point and a rearwardmost point opposite the forwardmost point; and an overall width, $W_o$, wherein, in an imaginary vertical plane perpendicular to the imaginary vertical hosel plane and spaced from the face center by a lateral distance no greater than $0.25*W_o$:

the exterior surface of the top portion includes a path comprising a first point and a second point rearward of the first point;

an imaginary infinite straight line passes through the first point and the second point, but does not penetrate the exterior surface of the top portion, a segment of the imaginary straight line delimited by the first point and the second point;

a two-dimensional space is bounded by the first point, the second point, the path, and the imaginary infinite straight line;

a maximum distance, $D_{max}$, measured perpendicular to the imaginary straight line, between the segment and the exterior surface of the top portion, is no greater than 0.70 mm;

a distance $D_1$ between the first point and the second point is no less than 22 mm; and a distance $D_2$ between the first point and the center apex, as projected into the imaginary vertical plane, is no less than 40 mm.

2. The golf club head of claim 1, further comprising a ratio, $D_1/D_2$, that is no greater than 3.0.

3. The golf club head of claim 2, wherein $D_1/D_2$ is no greater than 1.5.

4. The golf club head of claim 1, further comprising a ratio, $D_{max}/D_1$, that is no greater than 0.035.

5. The golf club head of claim 4, wherein $D_{max}/D_1$ is no greater than 0.030.

6. The golf club head of claim 1, wherein $D_{max}$ is no less than 0.20 mm.

7. The golf club head of claim 1, further comprising an overall length, $L_o$, such that $D_2/L_o$ is no less than 0.20.

8. The golf club head of claim 7, wherein $D_2/L_o$ is no less than 0.40.

9. The golf club head of claim 8, wherein $D_2/L_o$ is between 0.50 and 0.90.

10. The golf club head of claim 1, wherein $D_1$ is no less than 25 mm.

11. The golf club head of claim 1, wherein $D_{max}$ is no greater than 0.61 mm.

12. The golf club head of claim 1, wherein each point of the exterior surface of the top portion is located such that at least one imaginary infinite straight line passes through the point without penetrating the exterior surface of the top portion.

13. The golf club head according to claim 1, further comprising a distance, $D_5$, between the second point and the rearwardmost point, as projected into the imaginary vertical plane, the distance, $D_5$, being no greater than 45 mm.

14. The golf club head of claim 13, wherein $D_5$ is no greater than 20 mm.

15. The golf club head of claim 14, wherein $D_5$ is no greater than 15 mm.

16. The golf club head of claim 1, wherein the imaginary vertical hosel plane is spaced from the face center by a lateral distance no greater than $0.20*W_o$.

17. The golf club head of claim 16, wherein the imaginary vertical hosel plane is spaced from the face center by a lateral distance no greater than $0.15*W_o$.

18. A golf club head that, when oriented in a reference position, comprises:

a striking face including a face center;

a bottom portion and a top portion opposite the bottom portion, the top portion including an exterior surface;

a hosel including an imaginary centerline and an imaginary vertical hosel plane containing the imaginary centerline;

a forwardmost point and a rearwardmost point opposite the forwardmost point; and an overall length, $L_o$, no less than 105 mm, wherein, in an imaginary vertical plane perpendicular to the imaginary vertical hosel plane and passing through the face center:

the exterior surface of the top portion includes a path comprising a first point and a second point rearward of the first point;

an imaginary infinite straight line passes through the first point and the second point, but does not penetrate the exterior surface of the top portion, a segment of the imaginary straight line delimited by the first point and the second point;

a two-dimensional space is bounded by the first point, the second point, the path, and the imaginary infinite straight line;

a maximum distance, $D_{max}$, measured perpendicular to the imaginary straight line, between the segment and the exterior surface of the top portion, is no greater than 0.90 mm; and the first point and the second point are spaced by a distance $D_1$, such that a ratio, $D_{max}/D_1$, is no greater than 0.035.

19. The golf club head of claim 18, wherein:

the striking face further comprises a center apex; and in the imaginary vertical plane, the first point is spaced from the center apex by a distance, $D_2$, such that $D_1/D_2$ is no greater than 3.0.

20. The golf club head of claim 19, wherein $D_1/D_2$ is no greater than 1.5.

21. The golf club head of claim 19, wherein $D_2/L_o$ is no less than 0.20.

22. The golf club head of claim 21, wherein $D_2/L_o$ is no less than 0.40.

23. The golf club head of claim 22, wherein $D_2/L_o$ is between 0.50 and 0.90.

24. The golf club head of claim 18, wherein $D_{max}$ is no greater than 0.80 mm.

25. The golf club head of claim 18, wherein each point of the exterior surface of the top portion is located such that at least one imaginary infinite straight line passes through the point without penetrating the exterior surface of the top portion.

26. The golf club head according to claim 18, further comprising a distance, $D_5$, between the second point and the rearwardmost point, as projected into the imaginary vertical plane, the distance, $D_5$, being no greater than 45 mm.

27. The golf club head of claim 26, wherein $D_5$ is no greater than 15 mm.

28. A golf club head that, when oriented in a reference position, comprises:

a striking face including a face center;

a bottom portion and a top portion opposite the bottom portion, the top portion including an exterior surface;

a hosel including an imaginary centerline and an imaginary vertical hosel plane containing the imaginary centerline; and a volume no less than about 320 $cm^3$, wherein, in an imaginary vertical plane perpendicular to the imaginary vertical hosel plane and passing through the face center:

the exterior surface of the top portion includes a path comprising a first point and a second point rearward of the first point;

an imaginary infinite straight line passes through the first point and the second point, but does not penetrate the exterior surface of the top portion, a segment of the imaginary straight line delimited by the first point and the second point;

a two-dimensional space is bounded by the first point, the second point, the path, and the imaginary infinite straight line;

a maximum distance, $D_{max}$, measured perpendicular to the imaginary straight line, between the segment and the exterior surface of the top portion, is no greater than 0.90 mm; and the first point and the second point are spaced by a distance $D_1$, such that a ratio, $D_{max}/D_1$, is no greater than 0.035.

29. The golf club head of claim 28, wherein:

the striking face further comprises a center apex; and in the imaginary vertical plane, the first point is spaced from the center apex by a distance $D_2$, such that $D_1/D_2$ is no greater than 3.0.

30. The golf club head of claim 29, wherein $D_1/D_2$ is no greater than 1.5.

31. The golf club head of claim 29, further comprising:

a forwardmost point;

a rearwardmost point opposite the forwardmost point; and an overall length, $L_o$, such that $D_2/L_o$ is no less than 0.20.

32. The golf club head according to claim 31, further comprising a distance, $D_5$, between the second point and the rearwardmost point, as projected into the imaginary vertical plane, the distance, $D_5$, being no greater than 45 mm.

33. The golf club head of claim 32, wherein $D_5$ is no greater than 15 mm.

34. The golf club head of claim 31, wherein $D_2/L_o$ is no less than 0.40.

35. The golf club head of claim 34, wherein $D_2/L_o$ is between 0.50 and 0.90.

36. The golf club head of claim 28, wherein $D_{max}$ is no greater than 0.80 mm.

37. The golf club head of claim 28, wherein each point of the exterior surface of the top portion is located such that at least one imaginary infinite straight line passes through the point without penetrating the exterior surface of the top portion.

38. The golf club head of claim 28, wherein the volume is between about 400 $cm^3$ and about 460 $cm^3$.

* * * * *